US012788097B2

(12) United States Patent
Philibert et al.

(10) Patent No.: US 12,788,097 B2
(45) Date of Patent: Nov. 10, 2026

(54) SYSTEMS AND METHODS FOR ATTACHING ACCESSORIES TO HEADGEAR

(71) Applicant: METHOD INNOVATION PARTNERS INC., Surrey (CA)

(72) Inventors: Carl Philibert, Surrey (CA); Matthew Hunsberger, Vancouver (CA)

(73) Assignee: METHOD INNOVATION PARTNERS INC., Surrey (CA)

( * ) Notice: Subject to any disclaimer, the term of this patent is extended or adjusted under 35 U.S.C. 154(b) by 0 days.

(21) Appl. No.: 18/974,108

(22) Filed: Dec. 9, 2024

(65) Prior Publication Data

US 2025/0185748 A1 Jun. 12, 2025

Related U.S. Application Data

(60) Provisional application No. 63/607,313, filed on Dec. 7, 2023.

(51) Int. Cl.
*A42B 3/22* (2006.01)

(52) U.S. Cl.
CPC ..... *A42B 3/222* (2013.01)

(58) Field of Classification Search
CPC ..... A42B 3/222; A42B 3/225; A42B 3/04
See application file for complete search history.

(56) References Cited

U.S. PATENT DOCUMENTS 4,222,123 A * 9/1980 Hellberg ..... A42B 3/166 2/10
D264,141 S * 5/1982 Hellberg ..... D29/122
4,442,551 A * 4/1984 Hellberg ..... A42B 3/04 2/10
D276,950 S * 1/1985 Hellberg ..... D29/122
4,748,696 A * 6/1988 Fohl ..... A42B 3/223 2/10
5,012,528 A * 5/1991 Pernicka ..... A42B 3/225 2/10
D319,899 S * 9/1991 Pernicka ..... D29/109
5,966,738 A * 10/1999 Wang Lee ..... A42B 3/04 2/10
5,987,651 A * 11/1999 Tanaka ..... A42B 3/223 2/424
6,892,393 B1 * 5/2005 Provost ..... G02C 3/02 2/10
8,161,576 B2 * 4/2012 Lemke ..... A42B 3/145 2/418
8,245,320 B2 * 8/2012 Provost ..... A42B 3/185 2/442
D776,749 S * 1/2017 Cummings ..... D16/325
10,165,819 B2 * 1/2019 Klotz ..... A42B 3/04
11,213,089 B2 * 1/2022 Bohn ..... A42B 3/223
(Continued)

*Primary Examiner* — David M Upchurch
(74) *Attorney, Agent, or Firm* — Norton Rose Fulbright Canada LLP

(57) ABSTRACT

A clip system for attaching accessories to headgears is provided. The clip system comprises a clip assembly having a first clip attachable to a first accessory, a first clip-receiving adaptor attachable to a headgear, and an accessory adaptor attachable to the first clip-receiving adaptor. The first clip-receiving adaptor receives and fastens the first clip. The accessory adaptor receives and fastens an accessory to the first clip-receiving adaptor.

20 Claims, 44 Drawing Sheets

(56) References Cited

U.S. PATENT DOCUMENTS

| | | | | |
|---|---|---|---|---|
| 11,737,504 | B2 * | 8/2023 | Lee | A42B 3/222 2/9 |
| 2004/0181856 | A1 * | 9/2004 | Oleson | A42B 3/04 2/10 |
| 2004/0199982 | A1 * | 10/2004 | Wang-Lee | A42B 3/225 2/10 |
| 2005/0273912 | A1 * | 12/2005 | Gafforio | A42B 3/226 2/424 |
| 2012/0246807 | A1 * | 10/2012 | Klotz | A42B 3/225 2/243.1 |
| 2019/0133236 | A1 * | 5/2019 | Shida | A42B 3/185 |
| 2020/0146387 | A1 * | 5/2020 | Nimura | A42B 3/205 |

* cited by examiner

SYSTEMS AND METHODS FOR ATTACHING ACCESSORIES TO HEADGEAR

CROSS-REFERENCE TO RELATED APPLICATIONS

This claims the benefit of and priority to U.S. Provisional Patent Application No. 63/607,313, filed Dec. 7, 2023, the entire contents of which are incorporated by reference herein.

FIELD

The application relates generally to systems and methods for attaching accessories to headgear.

BACKGROUND

Personal protective equipment (PPE) is typically provided in standalone form. Users may want to simultaneously don a hat and (additional) PPE. Examples of hats include hard hats (typically safety certified) and bump hats (not necessarily certified). Examples of PPE include masks, visors, aprons, or face shields. The current generation of PPE for hard hats includes visors to protect construction works from debris and other projectiles, ear muffs for protecting workers for loud noise such as may be generated from machinery, and other similar PPE intended for construction sites.

Existing systems and methods do not always allow combining hats and (additional) PPE. Replacing exiting hard hat combinations with new hard hats may be costly and time consuming.

There are also other reasons to desire accessories to be efficiently added to headgear generally.

SUMMARY

In accordance with an aspect, there is provided a clip system for attaching accessories to headgears. The clip system comprises a clip assembly that includes a first clip attachable to a first accessory, a first clip-receiving adaptor attachable to a headgear, and an accessory adaptor attachable to the first clip-receiving adaptor. The first clip-receiving adaptor receives and fastens the first clip. The accessory adaptor receives and fastens an accessory to the first clip-receiving adaptor.

In this respect, before explaining at least one embodiment in detail, it is to be understood that the embodiments are not limited in application to the details of construction and to the arrangements of the components set forth in the following description or illustrated in the drawings. Also, it is to be understood that the phraseology and terminology employed herein are for the purpose of description and should not be regarded as limiting.

The prior art includes shield systems for hard hats that are fairly complex shield holders, usually made of plastic and is injection molded and the shield itself.

Many further features and combinations thereof concerning embodiments described herein will appear to those skilled in the art following a reading of the instant disclosure.

DESCRIPTION OF THE DRAWINGS

Embodiments will be described, by way of example only, with reference to the attached figures, wherein in the figures.

It is understood that throughout the description and figures, like features are identified by like reference numerals.

DETAILED DESCRIPTION

Embodiments of methods, systems, and apparatus are described through reference to the drawings.

Clip systems (and/or methods) are provided for use with a variety of headgear. Clip systems may include clips and/or other fastening means, such as rivets or threadable fasteners like nut/bolt pairs. Headgear may be helmets, hard hats, bump caps, etc. Headgear may or may not have brims.

Headgear may come preconfigured with features. Such features may be standard, common, or otherwise frequently available in industry headgear. Features may include side slots, e.g., a slot on each side of a hard hat or helmet. Features may also include a plurality of holes, e.g., breathing holes providing throughout the headgear.

Clips systems described herein may be universal clip systems in that they may be used for all or a wide range of headgear or certain classes of hats, e.g., certified construction industry hard hats. The clip systems described herein may also apply to other types of headgear, including bump caps or other types of hats.

In some embodiments, a clip system may attached to a headgear a shield or visor for protecting a user's face. In some embodiments, the visors or shields may protect from moisture, droplets, direct inhalation of dangerous gases, or communicable diseases (via transmission of bacteria or virions of viruses). As described herein, personal protective equipment may also be attached to existing work helmets (such as bump caps or hard hats).

In some embodiments, a clip system may be rugged to attach heavy-duty accessories. In some embodiments, clip systems may be light-weight and constructed of minimal material and configured to attach light-weight accessories to the headgear.

In some embodiments, clips systems may be configured to mate with features on headgear. Clips and/or other fastening means of clip systems may be complementary to features on headgear.

The clip system may comprise two clips. Each clip may be configured to attach to a lateral (side) end of the headgear via features on the headgear. A shield or visor may be attached to the clip system. One lateral (side) end of the shield may attach to one clip, while an opposing lateral (side) end of the shield may attach to the other clip. In some embodiments, the shield may be removably attached to the clips using fastening means such as, for example, being fixed or fused to the clips, or being attached via rivets.

Figure 1B:
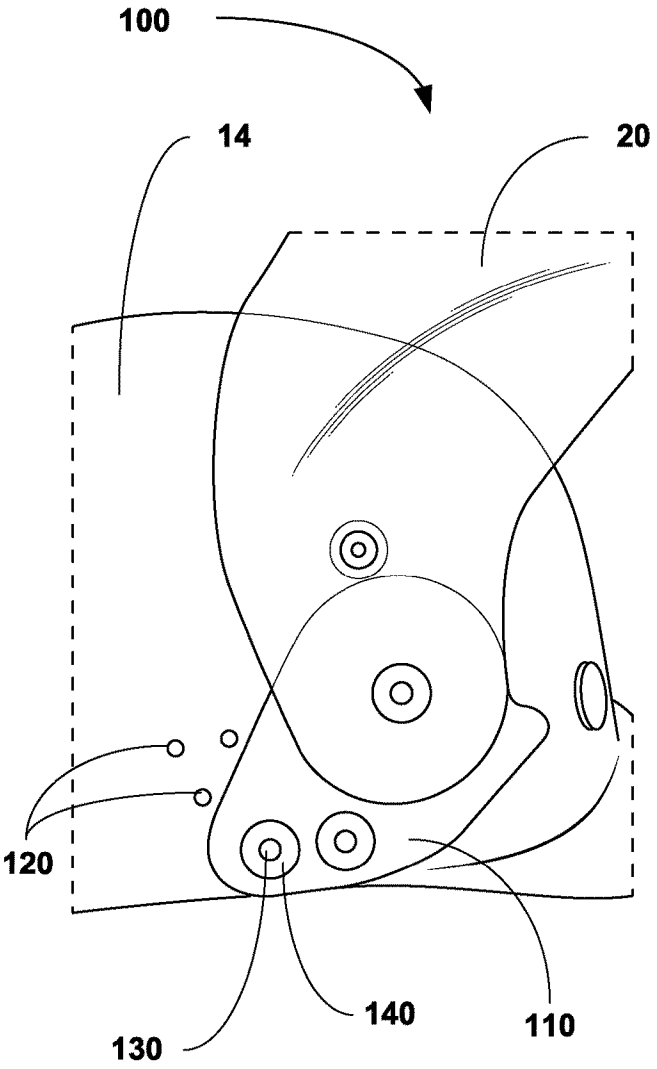
FIGS. 1A and 1B illustrate examples of a headgear using a clip system to attach a face shield (or visor), in accordance with some embodiments.
Figure 1A:
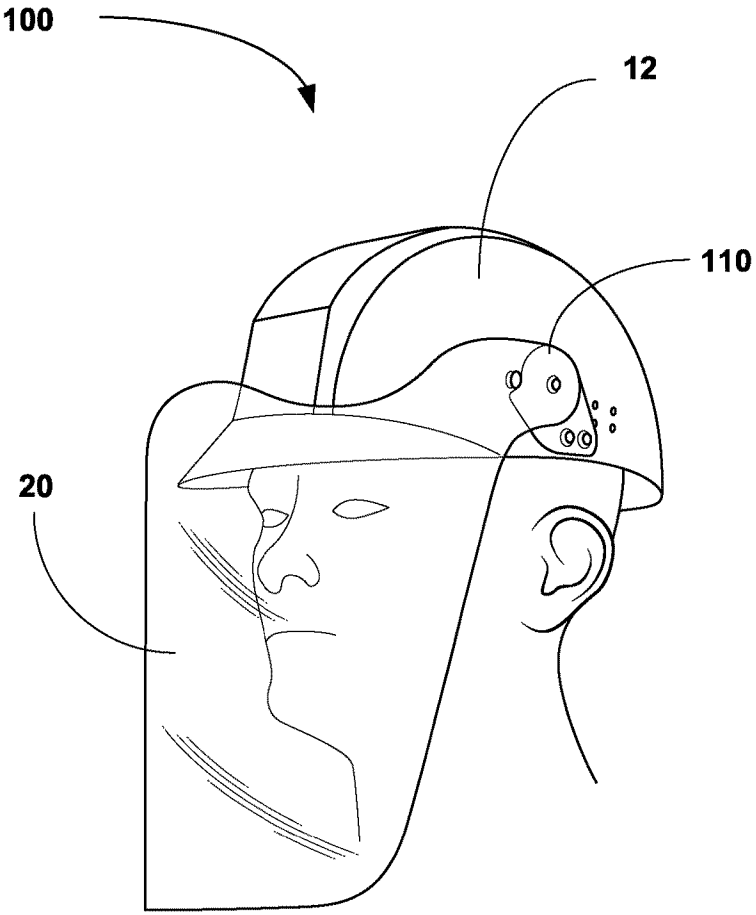

FIGS. 1A and 1B illustrate examples of a headgear using a clip system 100 to attach a face shield (or visor) 20, in accordance with some embodiments. FIG. 1A shows a bump cap 12 with the face shield 20 in the "down" position, FIG. 1B shows another bump cap 14 with the face shield 20 in the "up" position. In the examples shown in each figure, the clip 110 is riveted to holes 120 (using rivets 130 and washers 140) located on the sides of the headgear approximately above the ear of a user. The clip 110 may be riveted onto the bump cap 12, 14, or alternatively, be screwed with or without a washer onto the bump cap 12, 14.

In some embodiments, the clip 110 may be used for "bump hats" or "bump caps" that are non-certified light-weight caps. The clip 110 may be universal to all bump caps or most bump caps. A bump cap 12, 14 may not have side slots on either side so the clips 110 are to be fastened. The clip 110 may be assembled to the shield 20 and may include a stopper system to hold the shield in place at an angle. The clip 110 may be riveted or screwed into the bump cap 12, 14. Various darts (including plastic darts) may be used as a manual installation alternative to a rivet or screw for various industries. However, the food processing industry may prefer detectable hardware (e.g., metal hardware detectable via magnetic means) in case they fall into food.

In some embodiments, a clip 110 may comprise one or more members extending out of the clip 110, e.g., members may be threadable fasteners that may or may not be removable from the clip 110. In some embodiments, the members may fasten the clip onto corresponding one or more holes on the hat. For example, members may be fastened via an interference or friction fit, or by a rivet.

The clip 110 may be punched (e.g., from a plastic sheet). All (e.g., four) rivets 130 may be faced inwards so that interior or exposed part of the rivet 130 and washers 140 are on the inside facing toward the headgear. The outward or domed heads of the rivets 130 may then be facing out, holding the face shields 20 in place. In some embodiments, two #6 button head 'thread cutting' screws may then be used to hold the clips 110 in place by putting a backing plate (e.g., piece of 20 gauge punched steel plate) on the inside of the bump cap with two untapped holes on 12 millimetres (mm) centres. These self-tapping screws may tap out the ⅛" holes in the bump cap shell, and tap the holes in the steel sheet at the same time. No need for drilling and tapping. Users may be able to do all the work and may not need to use rivet guns for this purpose. The button head screws and the inner steel unthread plate may remove the requirement for 8 washers as either part may not damage the plastic parts. The use may only need a screwdriver to install the shields 20 as the inner plates may be held in place by hand until both screws are tightened. It should be understood that other sizes and types of material may be used.

Figure 2A:
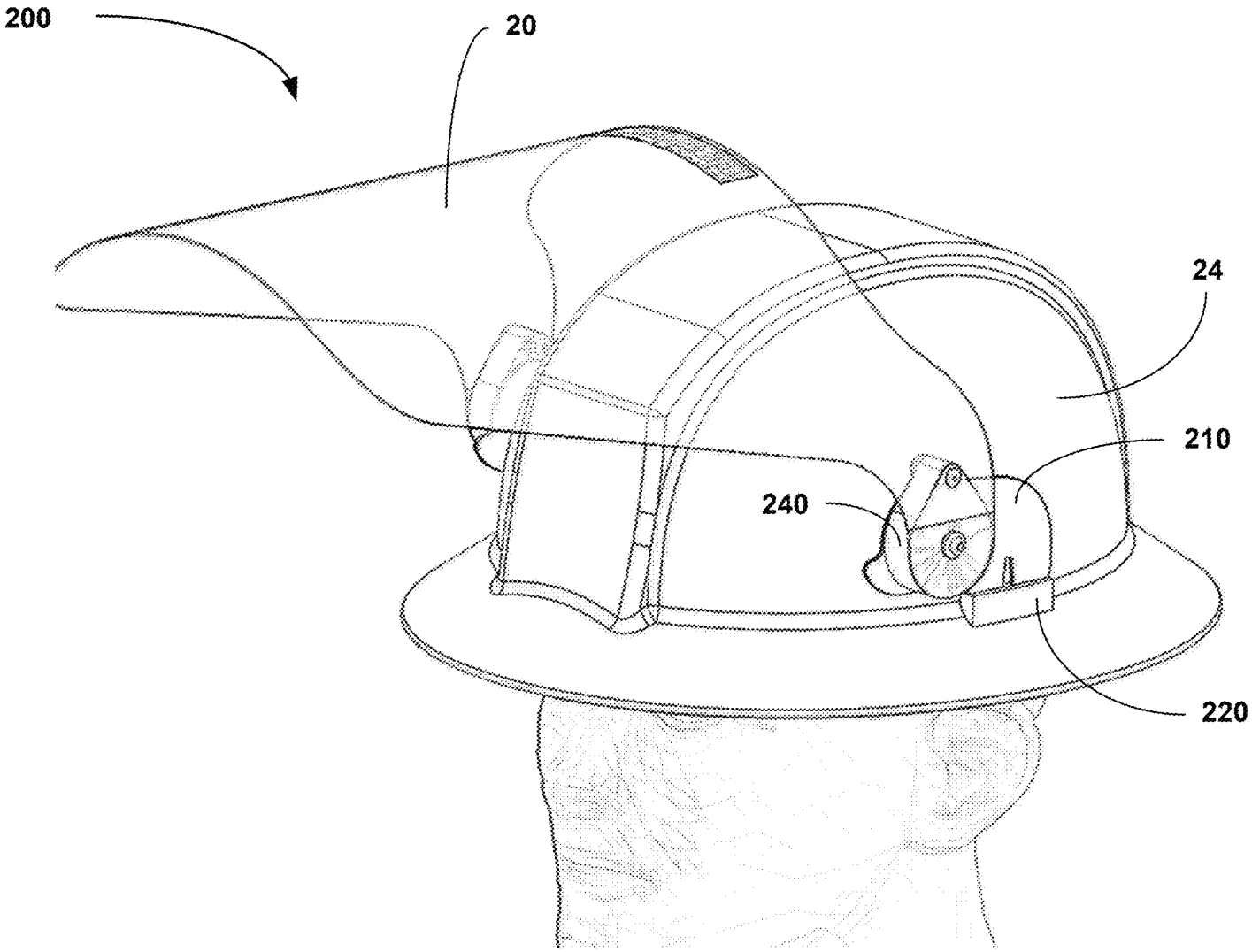
FIGS. 2A and 2B illustrate another example of a headgear using another clip system to attach accessories to the hard hat with brim, in accordance with some embodiments.
Figure 2B:
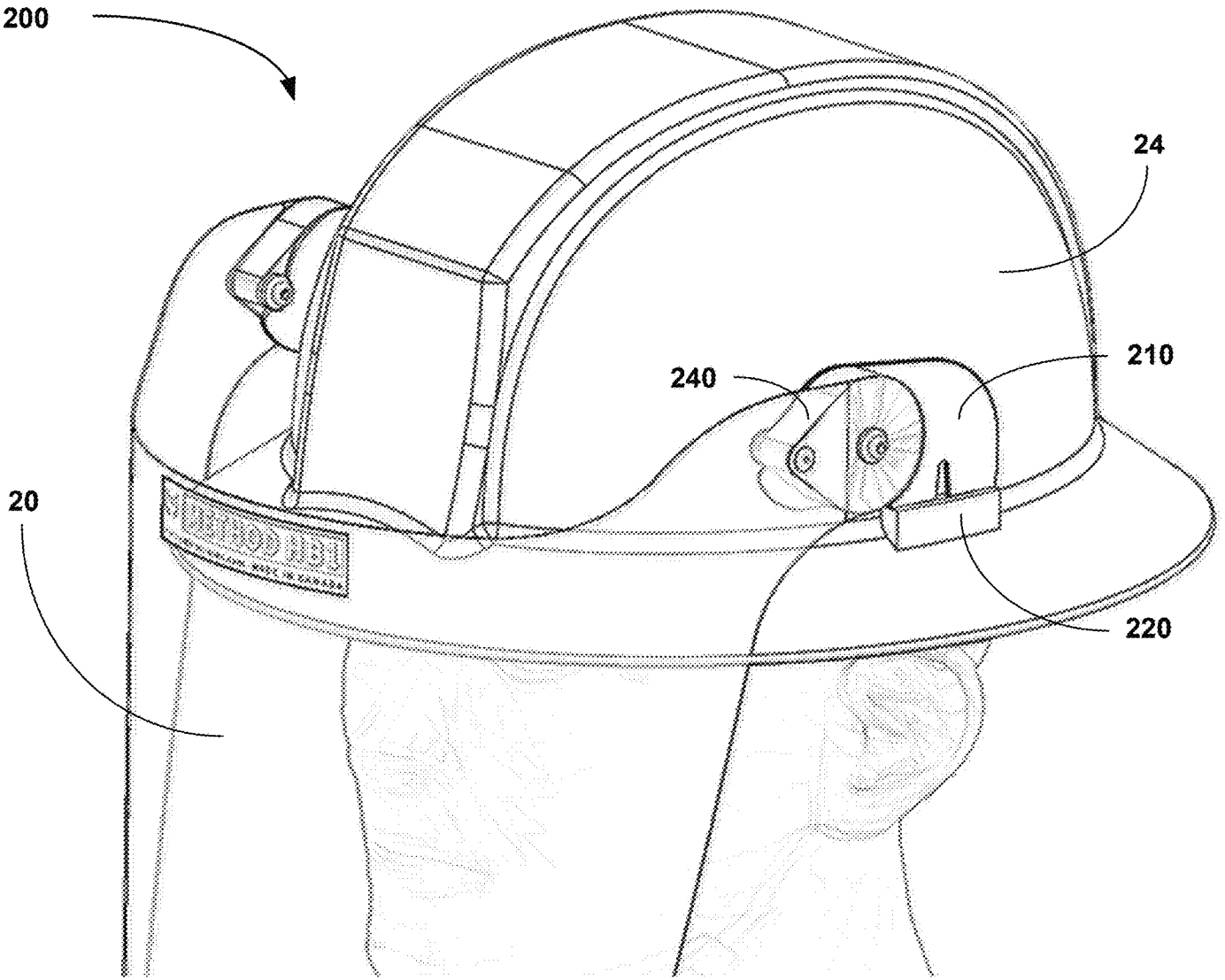

FIGS. 2A and 2B illustrate another example of a headgear using another clip system 200 to attach accessories to a hard hat with brim 24, in accordance with some embodiments. FIG. 2A shows the face shield 20 is in the "up" position, while FIG. 2B shows the face shield 20 in the "down" position. The clip system 200 uses earmuff slots 220 to connect the clip 210 to the hard hat 24. In some embodiments, a spacer component 240 may optionally be added to space the clip 210 (and the attached end of the face shield 20 or other accessory) a distance from the headgear. Spacer component 240 may be sized to a standard size of a brim of the headgear, or sized to a custom size based on the size of the brim of the headgear.

The spacer component 240 may be used to widen the pivot point of the shield 20 to avoid interference with swiveling from a brim all around a headgear. The spacer component 240 may be made of light plastic to reduce the overall weight, or made in a low cost or easier or faster manner using injection molded (for cost saving). In some embodiments, the spacer component 240 may comprise grey polyvinyl chloride (PVC) plastic in 1.5" rods. It should be understood that other sizes are possible depending on the headgear. In some embodiments, the spacer component 240 may have a built-in stopper.

Figure 3:
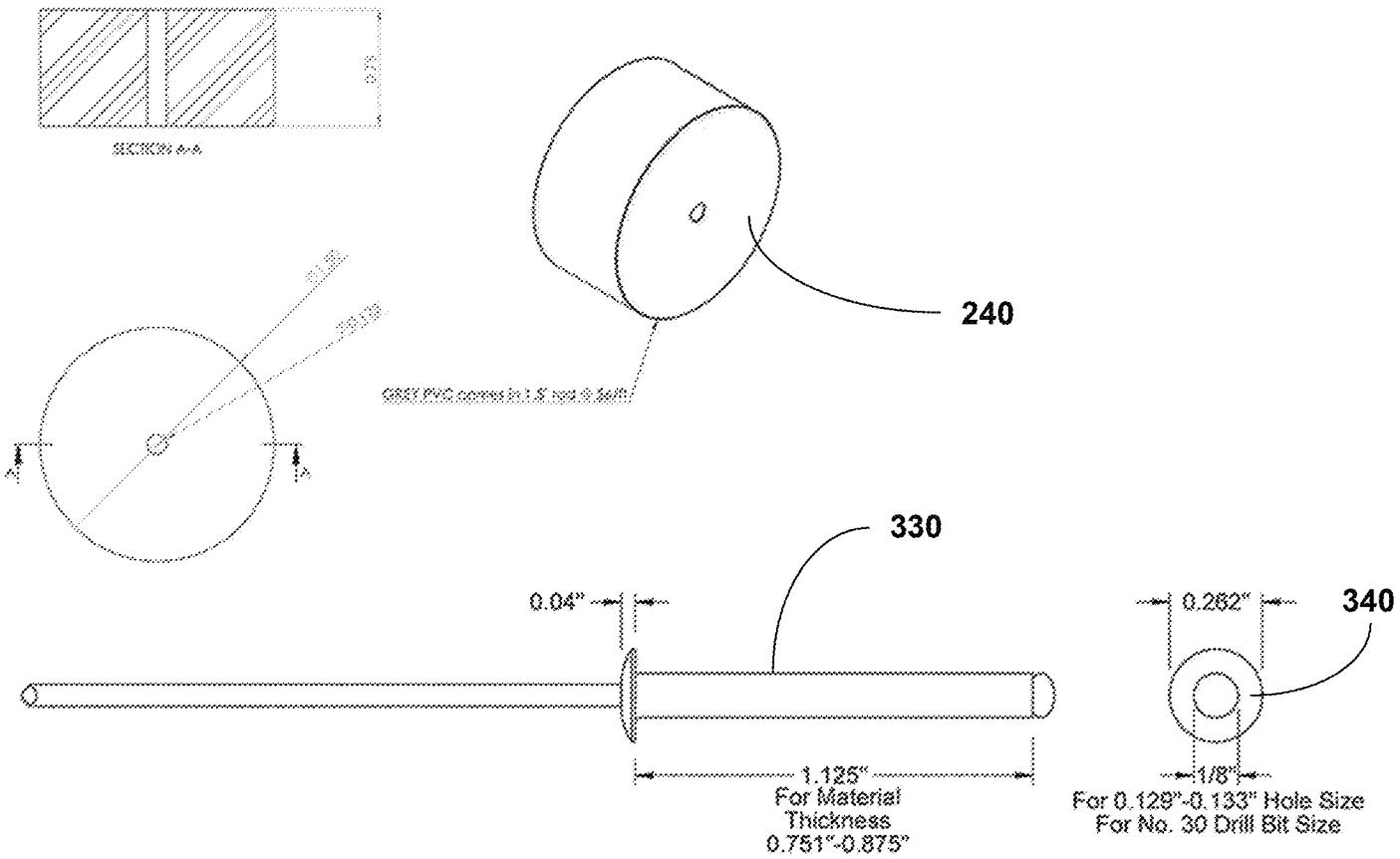
FIG. 3 illustrates an example of a spacer and fastener associated, in accordance with some embodiments.

FIG. 3 illustrates an example of a spacer 240 and associated fastener, in accordance with some embodiments. In the example shown, a longer rivet 330 that is approximately 1.125" may be used for material thickness between approximately 0.751"-0.865". A corresponding washer 340 that is approximately 0.262" in diameter with a hole of approximately 1/8" in diameter may be used for between approximately 0.129" to 0.133" hole size (e.g., for No. 30 drill bit size) may be used with or instead of the spacer component 240.

Figure 4A:
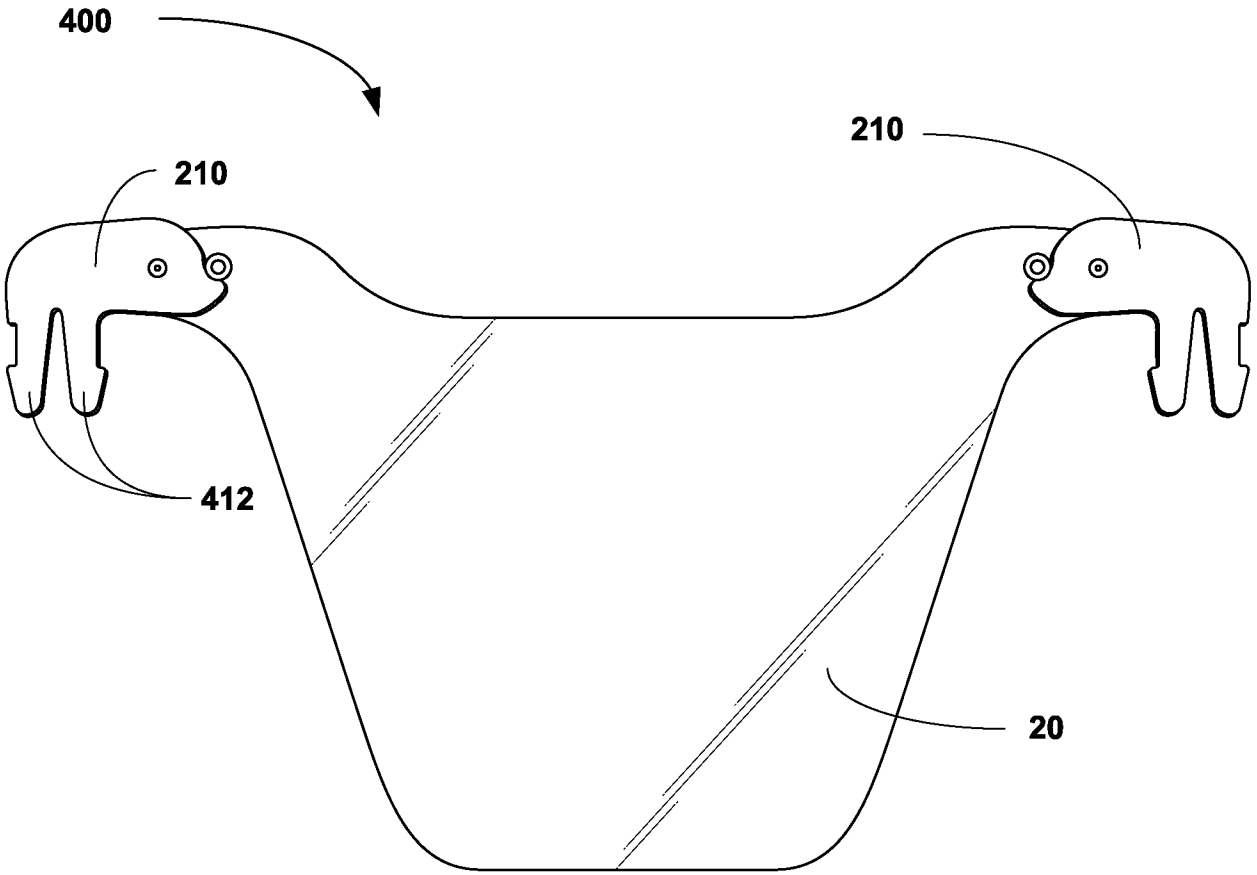
FIGS. 4A and 4B illustrate opposite plan views of a flat positioning of two clips attached to a shield/visor, from the "inside" and "outside" views, respectively, in accordance with some embodiments.
Figure 4B:
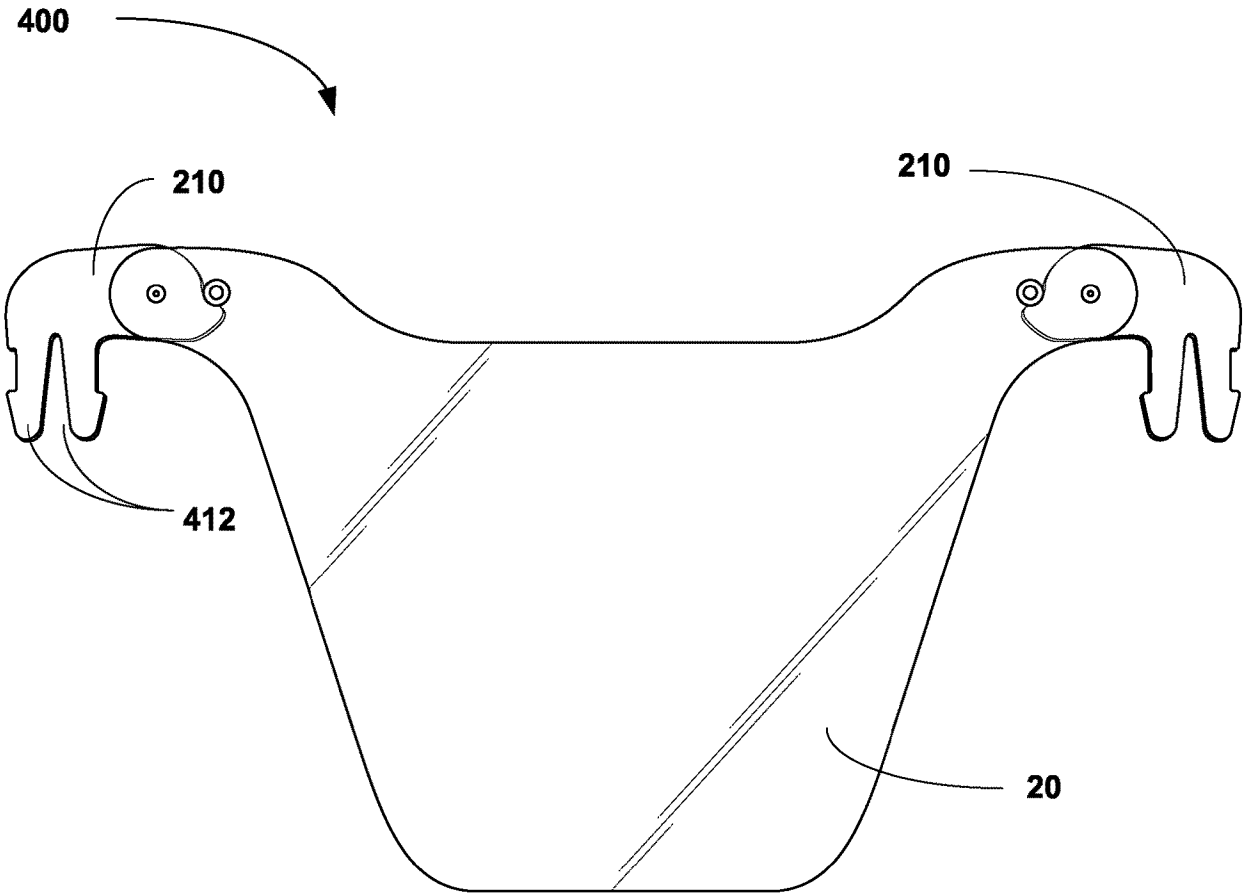

FIGS. 4A and 4B illustrate opposite plan views of a flat positioning of two clips 210 attached to a shield/visor 20, from the "inside" and "outside" views, respectively, in accordance with some embodiments. In some embodiments, the clips 210 and shield 20 together may form a flat package 400 for relatively easy shipping (to reduce cost and for efficiency). Similar flat packages may be provided for shield 20 and clips 110 combinations. Other variations of clips described herein may also be used.

In some embodiments, a clip 210 of a clip system 200 comprises two legs 412 with a spacing in-between and a predetermined or limited amount of flexibility so that the two legs 412 may be squeezed to reduce the spacing. The two legs 412 may be spaced apart sufficiently far to have a distance between peripheral edges greater than the size of a feature (such as a slot) on a headgear. The two legs 412 may mate or complementarily couple (in a fixed or substantially fixed way) with the feature via an interference or friction fit, wherein the friction is provided by residual stresses in the legs 412.

The clip system 100, 200 may be made of plastic, metal and/or other reusable or non-reusable materials. In some embodiments, the clips 110, 210 may be made of plastic but comprise metal rivets 130 to allow easy detection via metal detectors, e.g., in food processing plants.

In some embodiments, the design of the clip system 100, 200 (and/or shield 20) may allow for (mass) manufacturing rapidly and/or at low-cost using methods punching or simplified injection molding (single injection molded part or two injection molded parts).

In some embodiments, clips 110, 210 of the clip system 100, 200 are integral to the shield 20. In some embodiments, the shield 20 may be pre-punched to mate with the clips 110, 210. In some embodiments, the clip system 200 is universal to (nearly) all certified hard hats.

A process for manufacturing clips 100, 200 is punching, but various computer numerical control (CNC) processes can also be used to make them. In some embodiments, injection molding may also be used. Acrylonitrile butadiene styrene (ABS) or various other durable plastic or a blend of plastic may be used for manufacturing the clips 110, 210. Metal or various alloys may also be used, but may not offer the flexibility to snap into place as the legs of the clips 200 initially bend inward in order to slide through the slot and then spring back once the tabs have made their way through the slots in order to lock in place.

Clips 110, 210 may be assembled to the clear shield 20 at a manufacturing location by using rivets 130 and washers 140. Alternatively, end users may also be able to assemble the clips 110, 210 to the shield 20. A washer 140 for each rivet 130 may be used to make sure the assembly is secure for the life of the unit. Using rivets 130 through plastic without washers 140 on the other side may also work, but may not offer the same pressure. Additionally, without washers 140 the plastic shield portion attached to the clip 110, 210, may wear out over time and "fall" off the rivet 130. Stainless steel rivets 130 and/or washers 140 may also be used. Stainless steel rivets 130 may deform plastic and may make it difficult to rotate the shield 20. The shields 20 may be rotatable to create the desirable distance between the shield 20 and the face to reduce fogging. The rivet 130 may be replaced by various other hardware like a nut and screw assembly, which would allow for the shield 20 to be replaced. In some embodiments, the speed of assembly using a washer 140 and a rivet 130 is relatively fast.

Figure 5A:
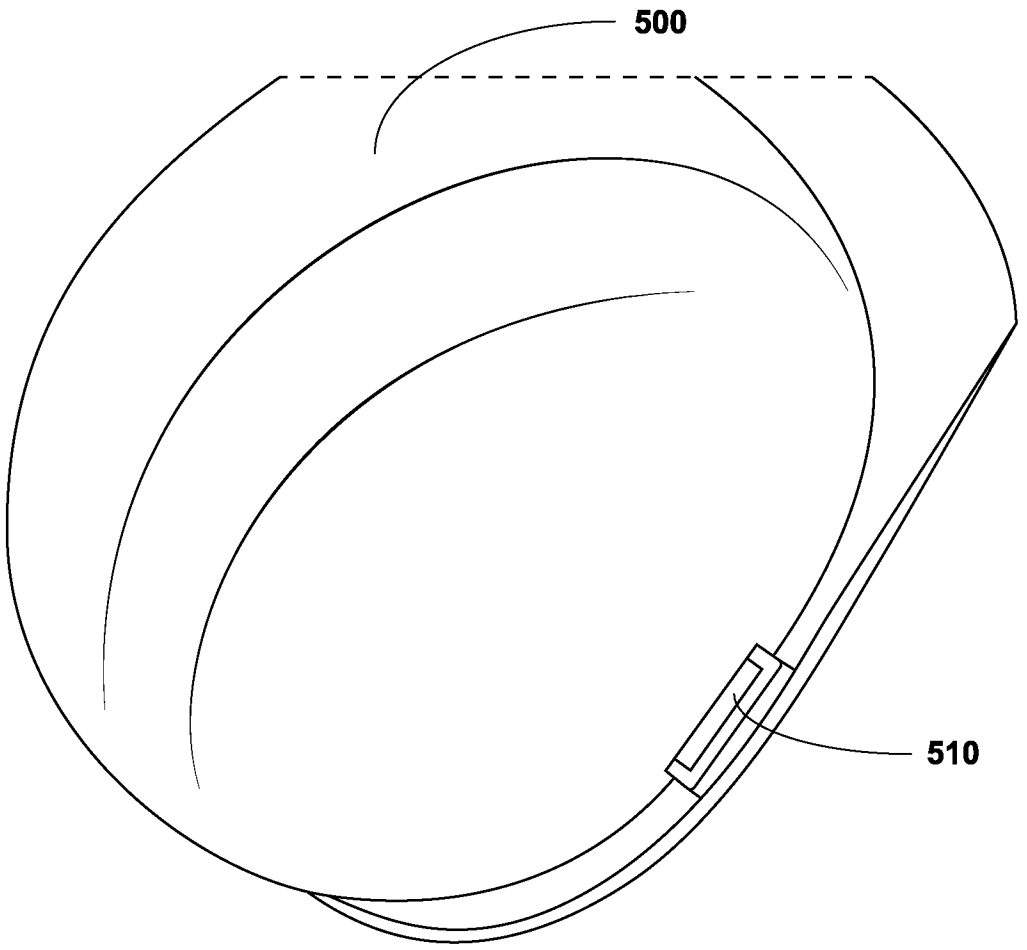
FIG. 5A illustrates and example of a hard hat with a slot in the helmet.

A typical hard hat includes a slot within which accessories (e.g., earmuffs) may be attached. FIG. 5A illustrates and example of a hard hat 500 with a slot 510 in the helmet. The clips 210 may be sized for the slots 510 in a headgear. In some embodiments, the same clip 210 may be used for all hard hats, whether brimmed or not. Most hard hats have slightly different sized slots, but the same set of clips 210 may fit several hard hat models. For slots of different sizes, a series of clip 210 sizes may be available.

Figure 5B:
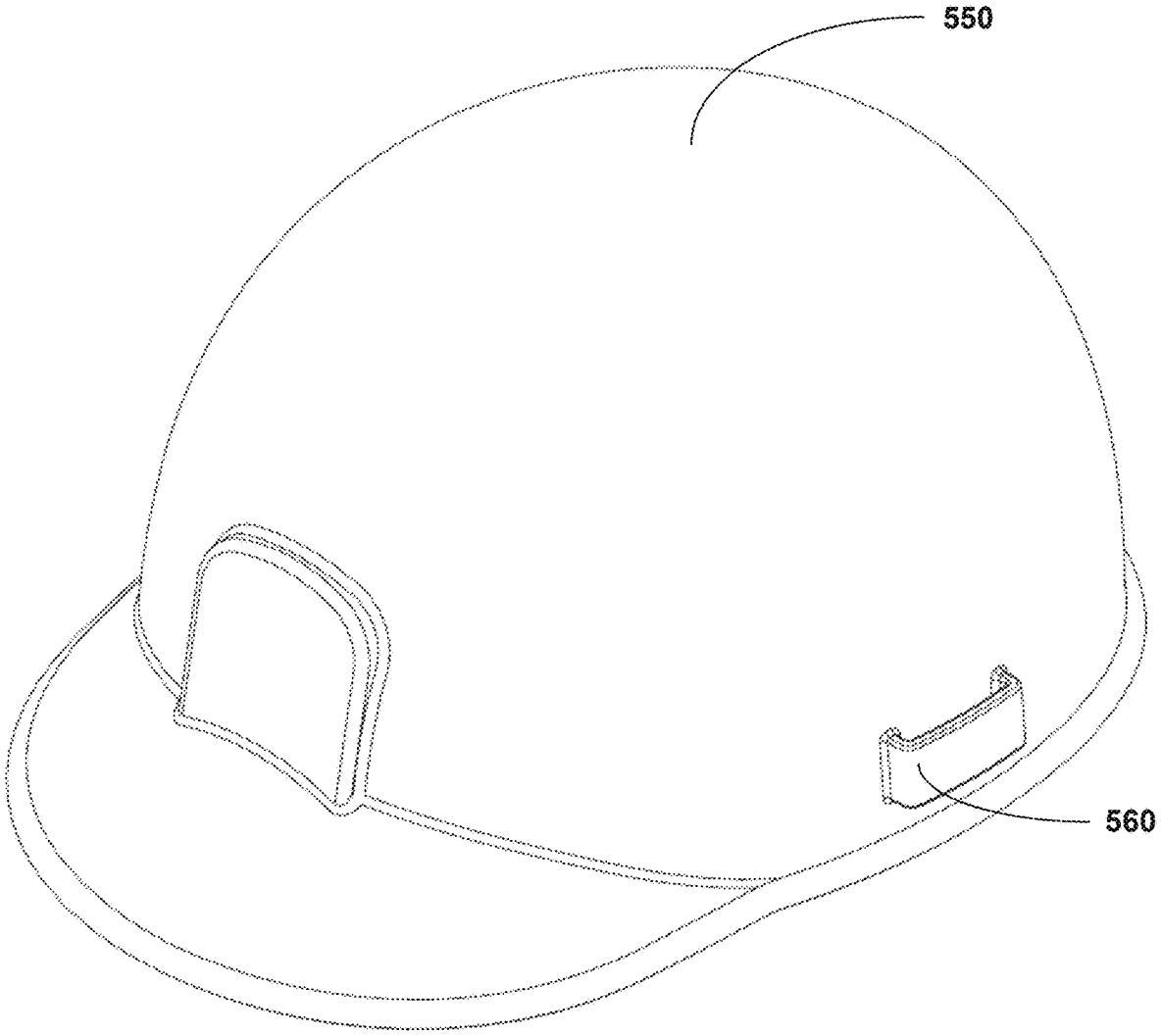
FIG. 5B illustrates an example of a bump cap with a moulded slot, in accordance with some embodiments.

Some headgear may not have a slots (e.g., bump caps). Such headgear may be generated having moulded slots. FIG. 5B illustrates an example of a bump cap 550 with a moulded slot 560, in accordance with some embodiments. It should be understood that additional moulded slots 560 may be added in various other locations on the bump cap 550 where it is desired to attach an accessory. For example, corresponding moulded slots 560 may be moulded to each side of the headgear to hold earmuffs or visors 20 having clips 210. Additionally, a moulded slot 560 may be added to the top or another location on the bump cap 550 to hold a light source, camera, sensor or other accessory.

Figure 6A:
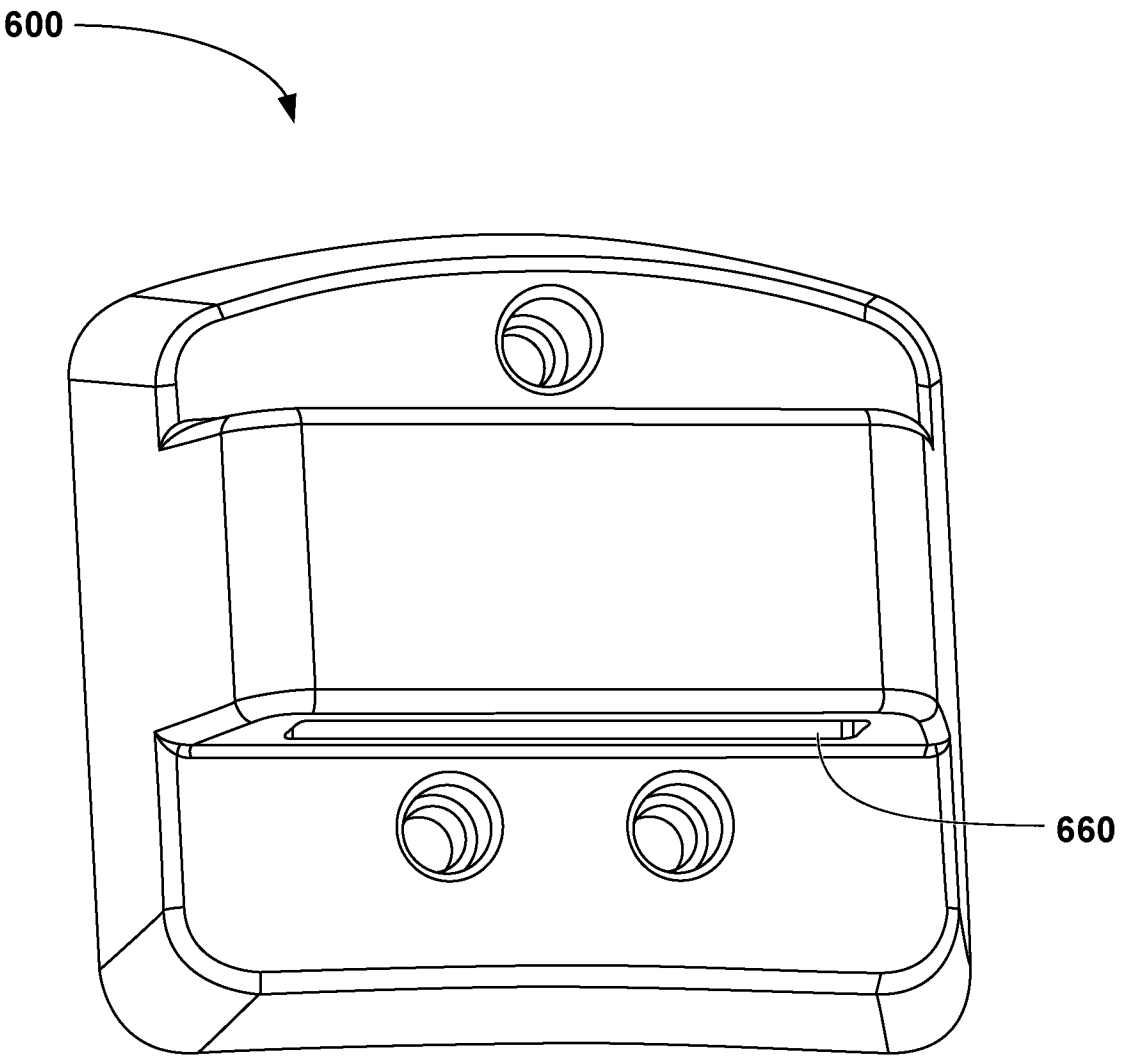
FIG. 6A illustrates an example of a slot adaptor, in accordance with some embodiments.
Figure 6B:
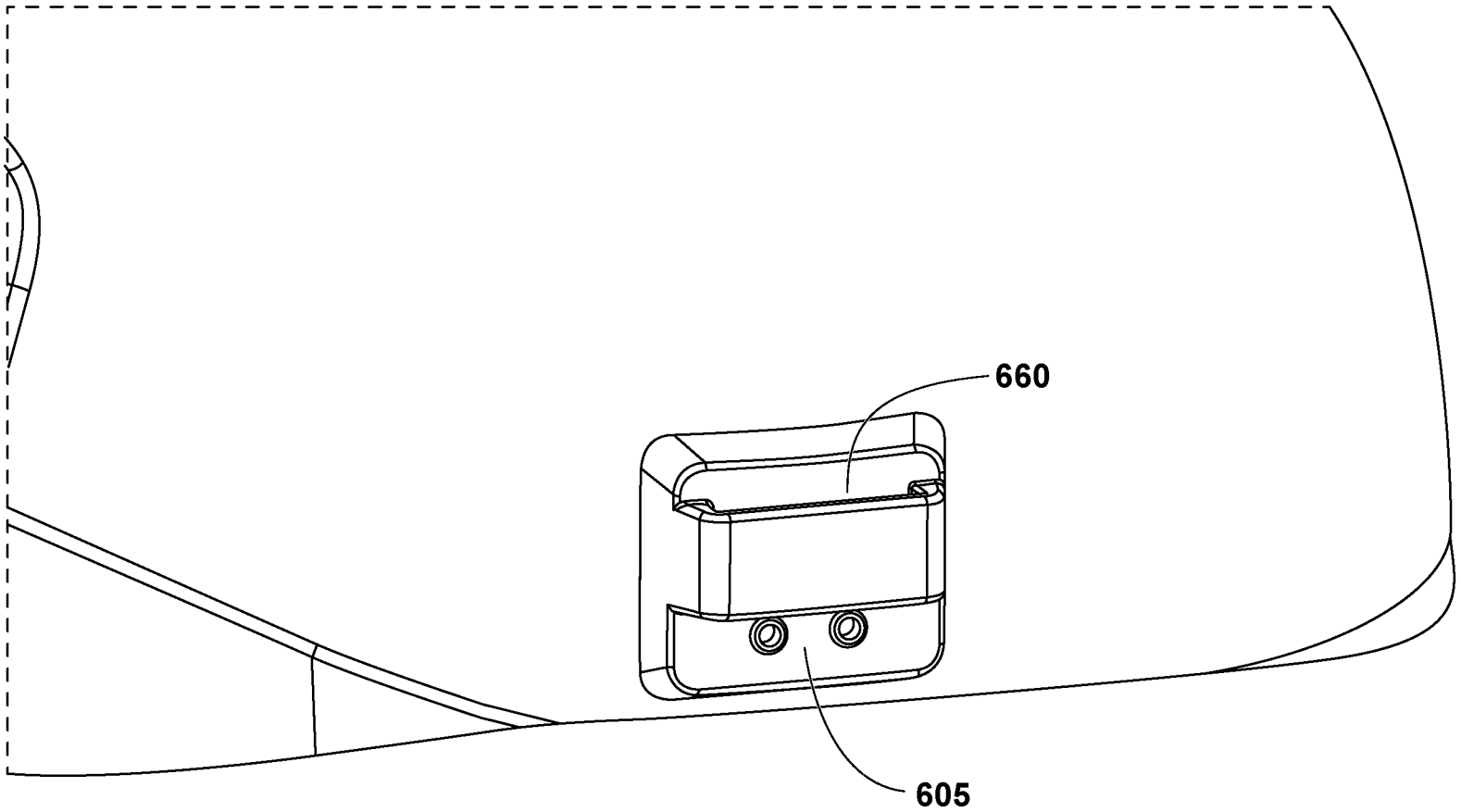
FIG. 6B illustrates the slot adaptor attached to a bump cap, in accordance with some embodiments.
Figure 6C:
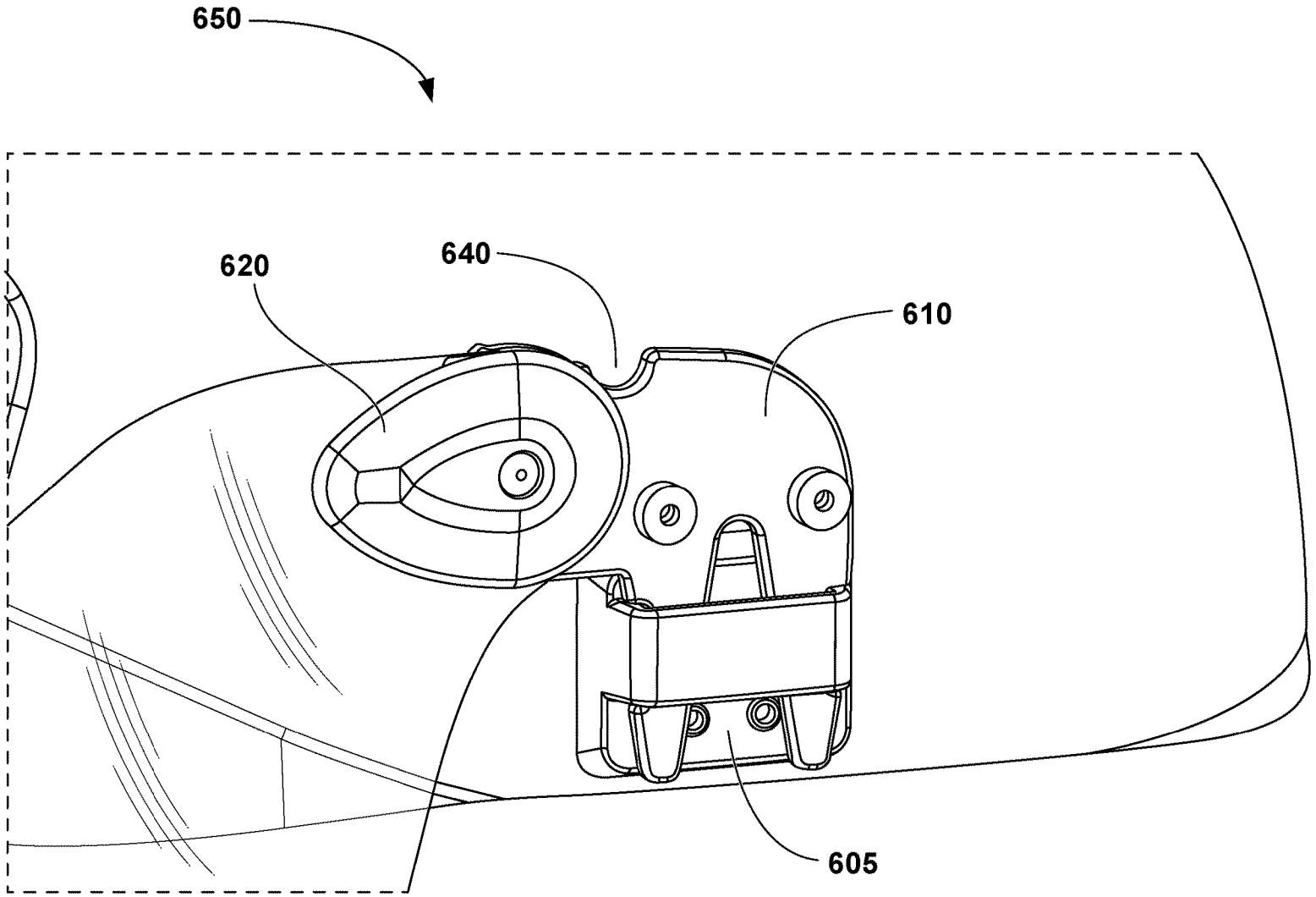
FIG. 6C illustrates an example of a clip system inserted into the slot adaptor attached to the bump cap, in accordance with some embodiments.

An alternative to building a new bump cap with moulded slots 560 is to attach a slot adaptor component to an existing headgear. FIG. 6A illustrates an example of a slot adaptor 600, in accordance with some embodiments. The slot adaptor 600 may sometimes be referred to herein as a clip-receiving adaptor. FIG. 6B illustrates another example of a slot (or clip-receiving) adaptor 605 attached to a bump cap, in accordance with some embodiments. In this example, the adaptor 605 is installed using two ⅛" diameter rivets. The adaptor 600, 605 may accept a shield 20, earmuff or other accessory locking tab (or clip). FIG. 6C illustrates another example of a clip system 650 inserted into the slot adaptor 605 that is attached to the bump cap, in accordance with some embodiments. The clip system 650 includes a clip 610, an indentation 640, a swivel joint 620 and an adaptor 605.

Via injection molding, an adaptor 600, 605 may be manufactured that will get permanently attached to the bump cap by the end user. The adaptor 600, 605 will have a (clip-receiving) slot in it to replicate the slot of a hard hat. That injection molded piece may be attached to the bump cap via rivets, nuts and screws, self-tapping screw into a pre-drilled backing plate, or even double sided tape to the side of the helmet or other headgear. Some embodiments may include double side tapping the clip 210 without using the slot on a hard hat. A clip system 200 for bump caps may be provided to mimic a hard hat side slot. With that system, instead of using a clip 110 with two holes on the side that gets attached to the side of the bump cap, a modified clip 210 or perhaps the same clip 210 may be used in combination with adaptor 600, 605 attached to the headgear.

In some embodiments, the clips 110, 210 of the clip system 100, 200 may be universal adapters for any type of headgear. In some embodiments, the clips 110, 210 of the clip system 100, 200 may be considered separately from the visor/face shield 20, allowing for components (such as the face shield 20) to be replaced without the need to replace the entire system 100, 200 with or without adaptors 600.

The clip 650 design may have an indentation 640 built in that works in conjunction with a pin (e.g., made of a rivet holding the shield 20 in place) along with two washers sitting next to each other that are on the other side of the shield 20. Alternatively, the pin may be a larger in diameter rivet or other component 780 holding the shield in place. The role of the pin (and/or two washers) is to be received by the indentation 640 of the clip 610, and thereby stop the rotation of the shield 20. To stop or limit the rotation of the accessory, in one direction washers may stop at the clip indentation 640, and in the other direction the washer may simply stop at the profile (or other indentation) 645 of the clip 610. Other hardware may be used to create the rotation stopping mechanism.

In some embodiments, each clip 610 may be connected to a swivel joint 620 for allowing swiveling of the shield 20. In some embodiments, each clip 610 may include a bind and post (flat edged head screw) and/or a threaded post. In some embodiments, the clip system 100, 200, 650 may be provided with one or more aluminum washers, e.g., to allow riveting to plastic. In some embodiments, the clip system 100, 200, 650 may comprise stoppers for preventing the visor 20 from rotating (or falling down) past a certain point, and a rivet or other component dedicated to this purpose. In some embodiments, the clip system 100, 200, 650 may comprise one or more spacer components 240 to accommodate a brim of the headgear. In some embodiments, the shield 20 may be manufactured by punching it. Various other processes may be used, such as CNC trimming (router, waterjet, laser, etc.).

If the earmuff slots on a hard hat (or adaptors 600, 605 on headgear) are used for the clip system 200 to hold a visor 20, then additional slots (or adaptors) are needed for the earmuffs to be used in conjunction with the visor 20. In some embodiments, the clip 110, 210, 610 may comprise holes to allow for a modified adaptor to be attached thereto. In some embodiments, the modified adaptor may be designed to be attached to an accessory (e.g., attach adaptors to the earmuffs and then attach the clip (or a modified clip designed to mate with the modified adaptor) connected to the visor 20 to those adaptors). In some embodiments, several accessories may be added in series using multiple adaptors.

Figure 7A:
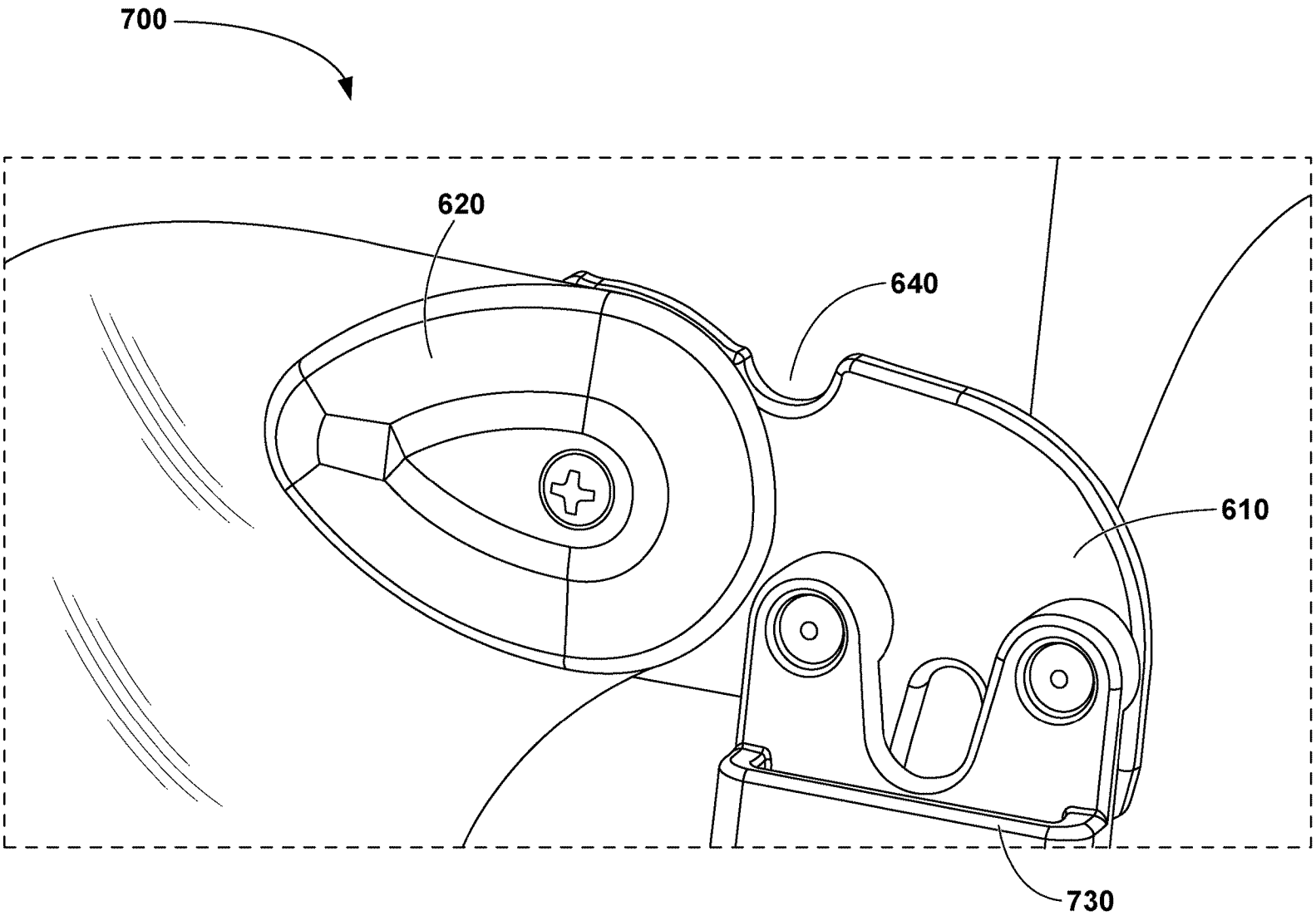
FIG. 7A illustrates a front view of another example of a clip system, in accordance with some embodiments.

FIG. 7A illustrates a front view of another example of a clip system 700, in accordance with some embodiments. The clip system 700 comprises the clip 610, the swivel joint 620, an additional adaptor 730 attached to the clip 610, and optionally the indentation 640.

Figure 7B:
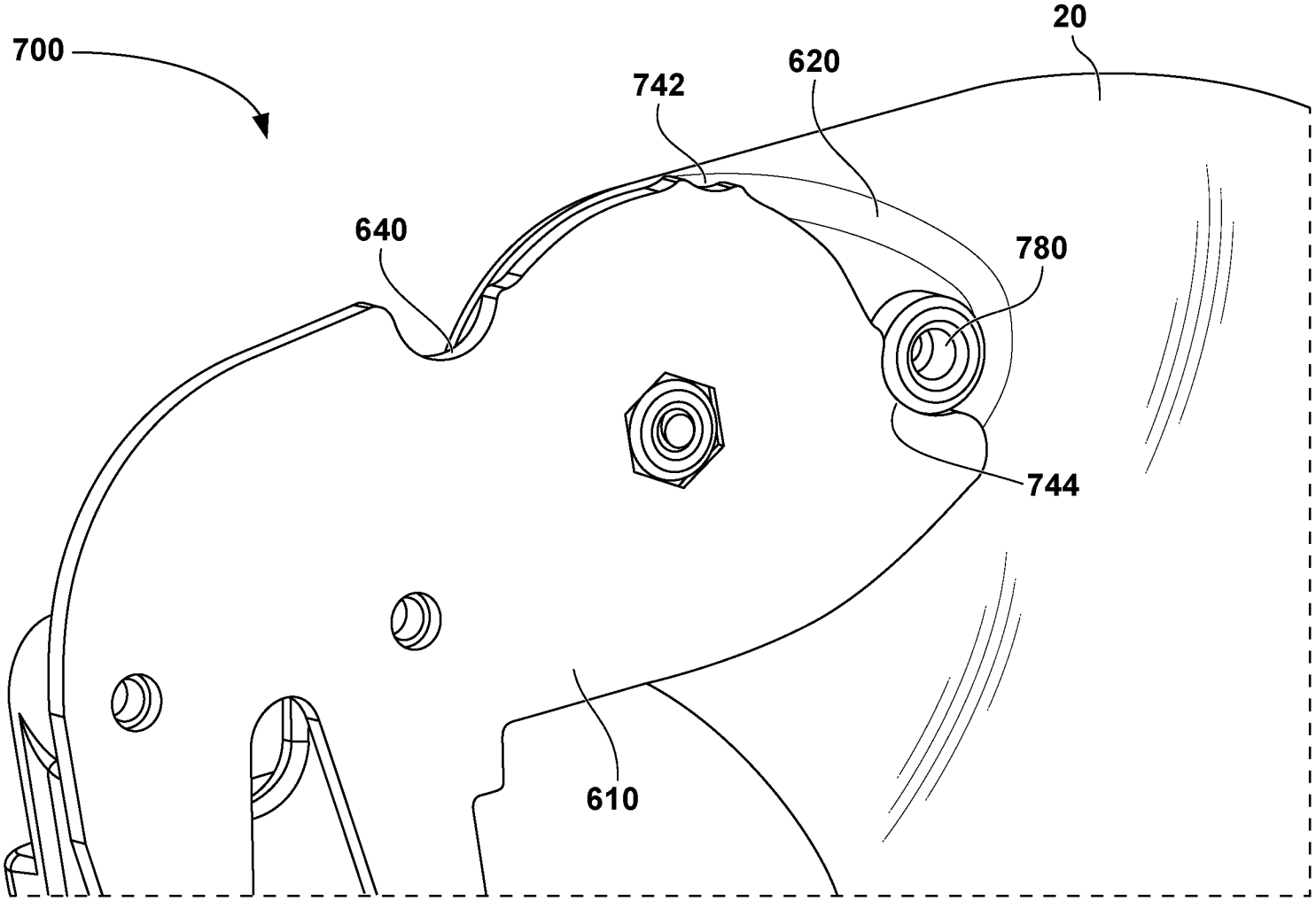
FIG. 7B illustrates a rear view of the clip system, in accordance with some embodiments.
Figure 7C:
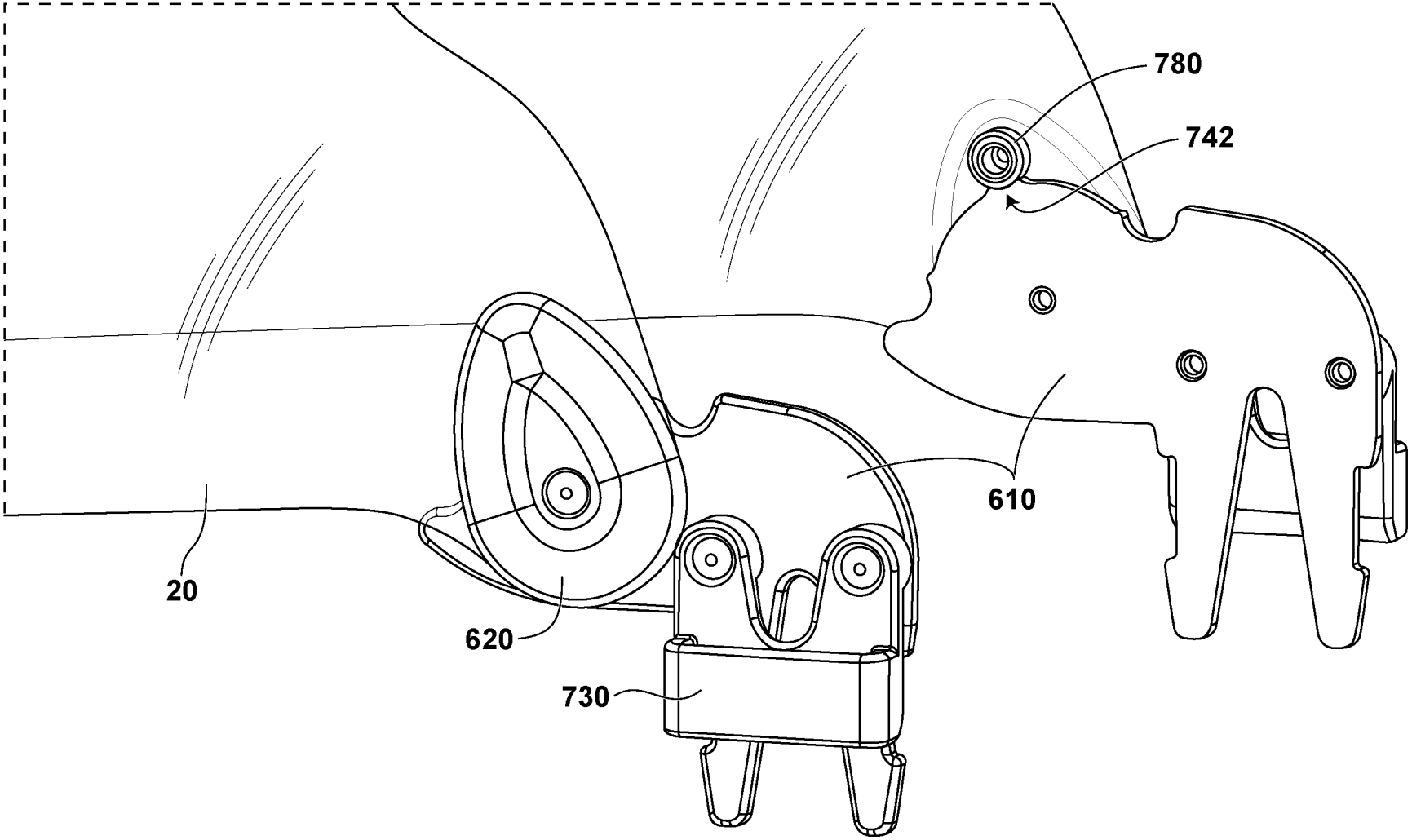
FIGS. 7C and 7D show the face shield in the intermediate position, in accordance with some embodiments.
Figure 7D:
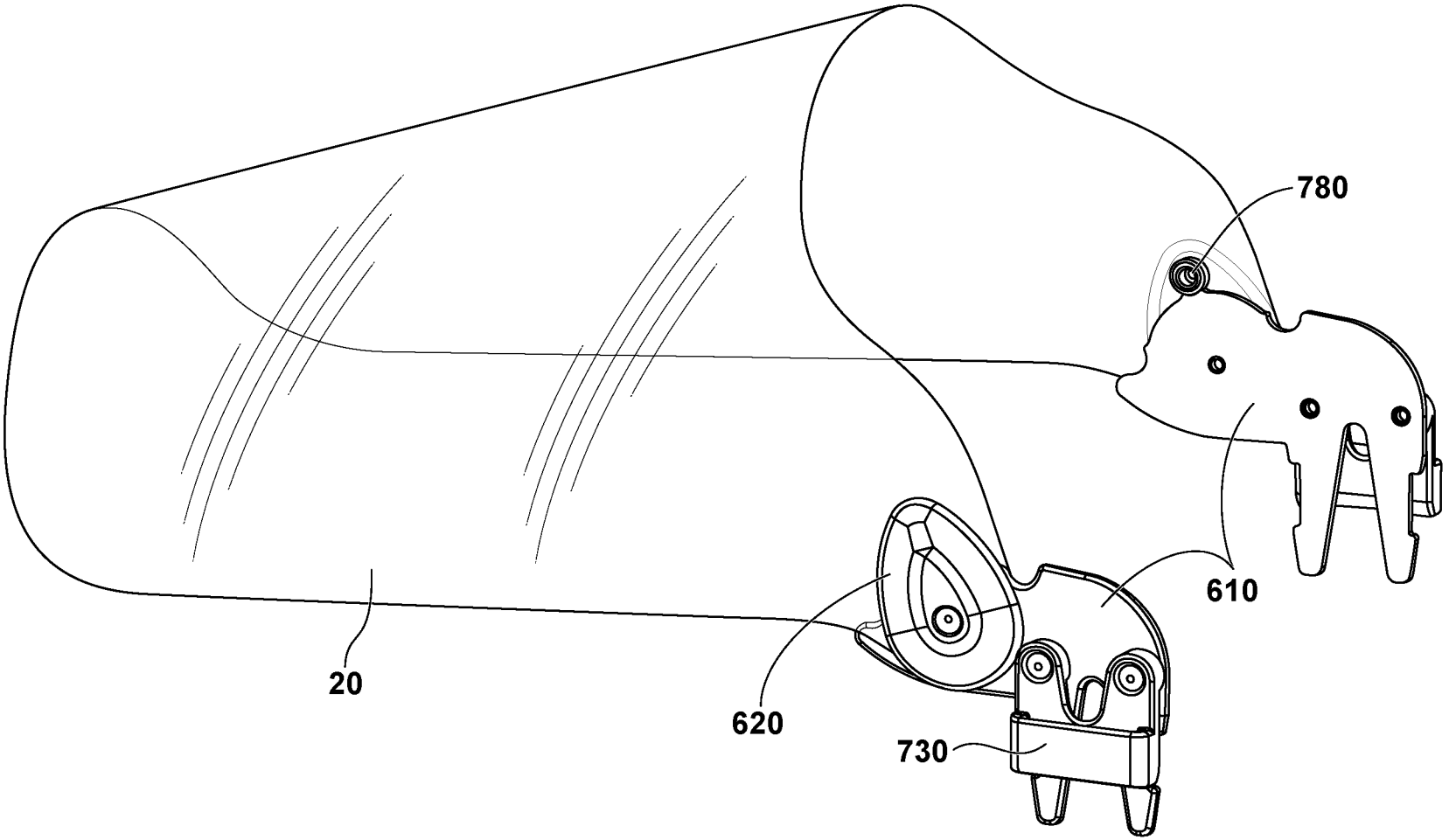
Figure 7E:
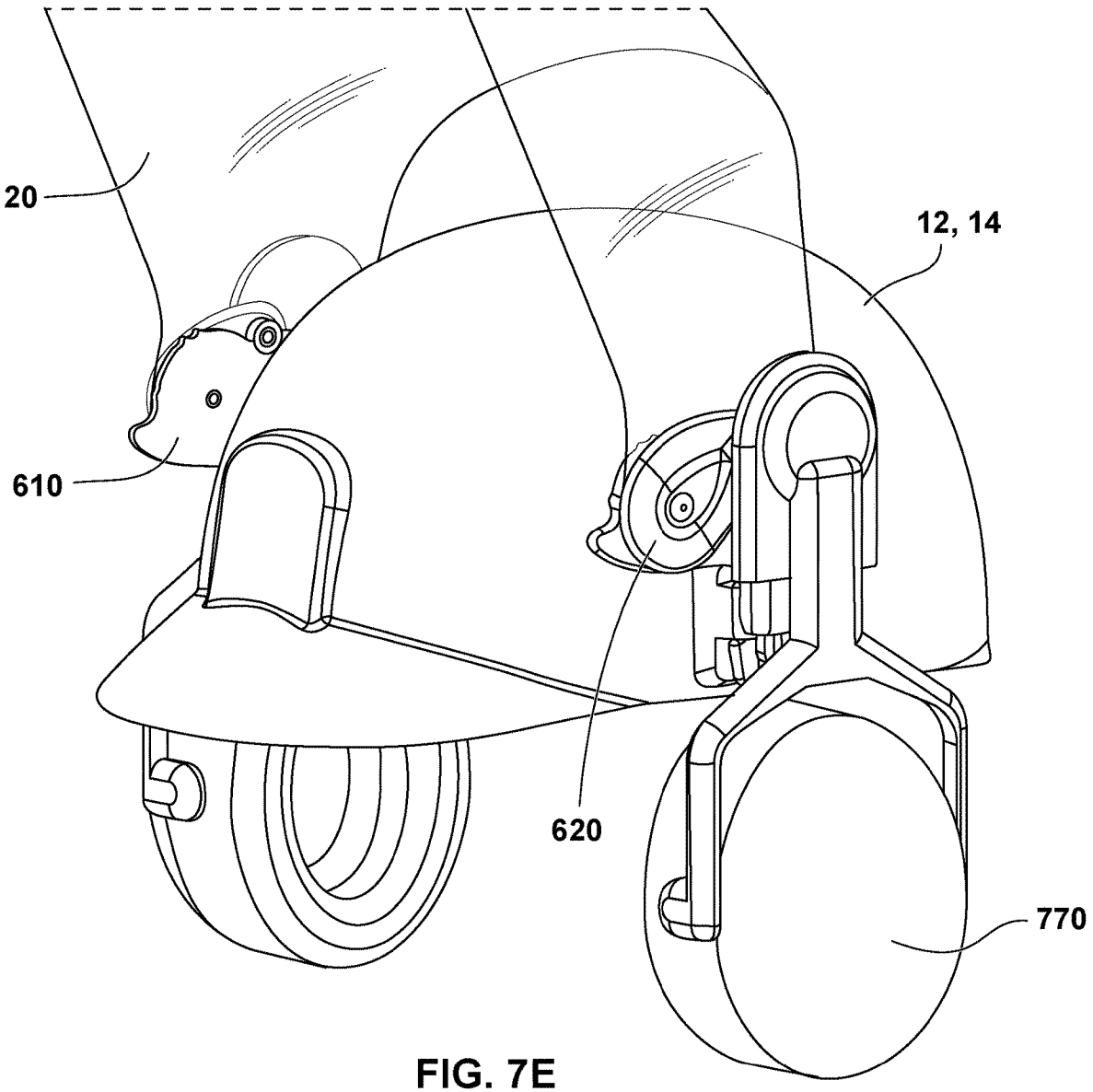
FIG. 7E shows the face shield in the "up" position with the pin at indentation, in accordance with some embodiments.

FIG. 7B illustrates a rear view of the clip system 700, in accordance with some embodiments. FIG. 7B shows three indentations at 640 (0 degrees or face shield in "down" position), 742 (70 degrees) and 744 (140 degrees or face shield 20 in "up" position), in accordance with some embodiments. Swivel pin 780 is in indentation 744 (i.e., which corresponds to the face shield 20 in the "up" position). FIGS. 7C and 7D show the face shield 20 in the intermediate position with the pin 780 at indentation 642, in accordance with some embodiments. This position corresponds to the face shield 20 in the intermediate position at approximately 70 degrees. FIG. 7E shows the face shield in the "up" position with the pin 780 at indentation 744, in accordance with some embodiments. An earmuff 770 is also shown attached to the additional adaptor 730.

Figures 7F, 7G:
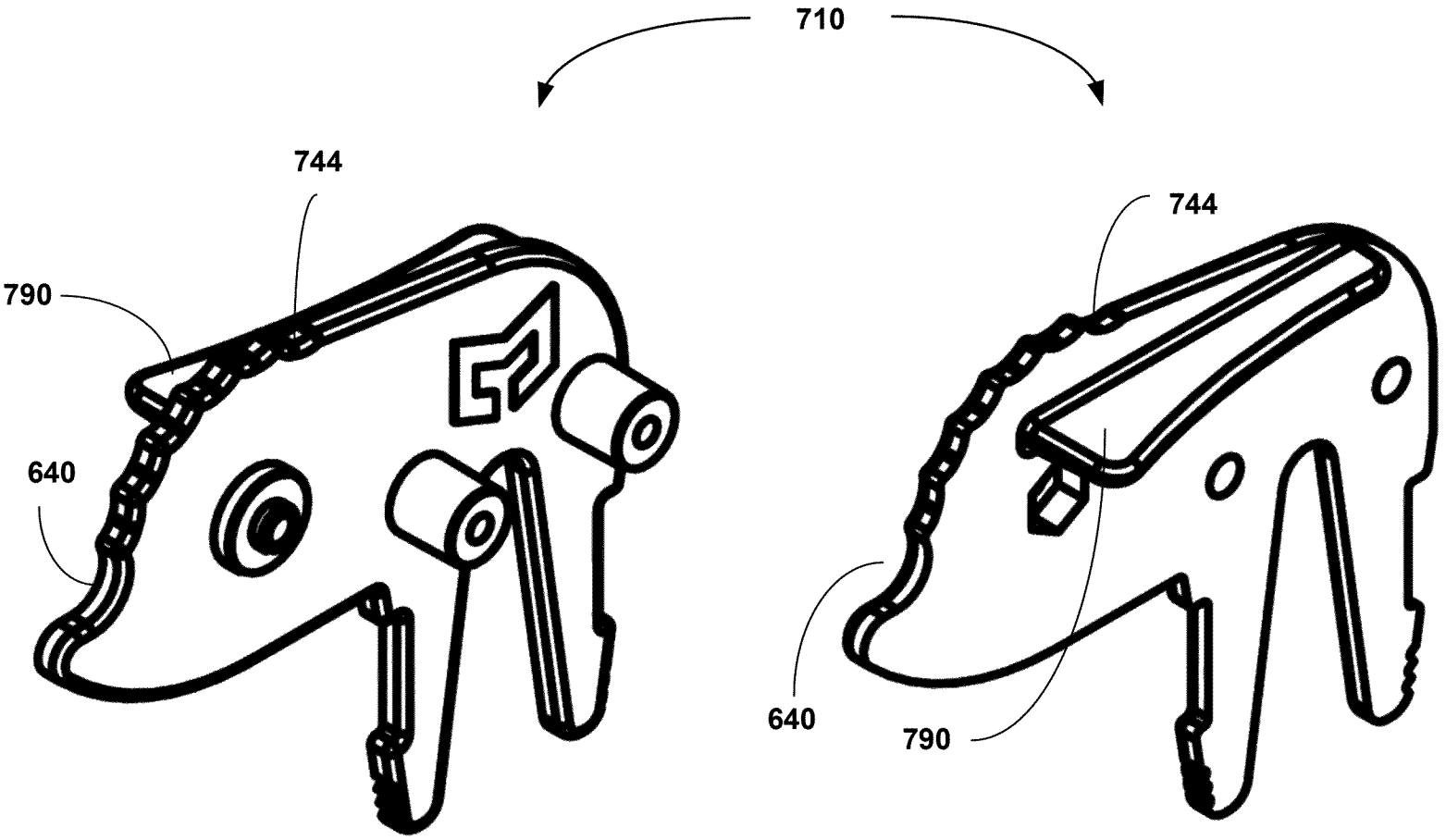
FIGS. 7F and 7G illustrate the outer view and inner view, respectively, of another example of a clip, in accordance with some embodiments.

FIGS. 7F and 7G illustrate the outer view and inner view, respectively, of another example of a clip 710, in accordance with some embodiments. Clip 710 has several indentations between the "up" position indentation 744 and "down" position indentation 740. Clip 710 also show a spacer component 790 which rests on the side of the headgear to which the clip 710 is attached when the weight of earmuffs 770 are added to a clip system 700. This spacer component 790 allows for the integrity of the clip to be maintained despite the weight of attached earmuffs 770 or other accessories.

Figure 8A:
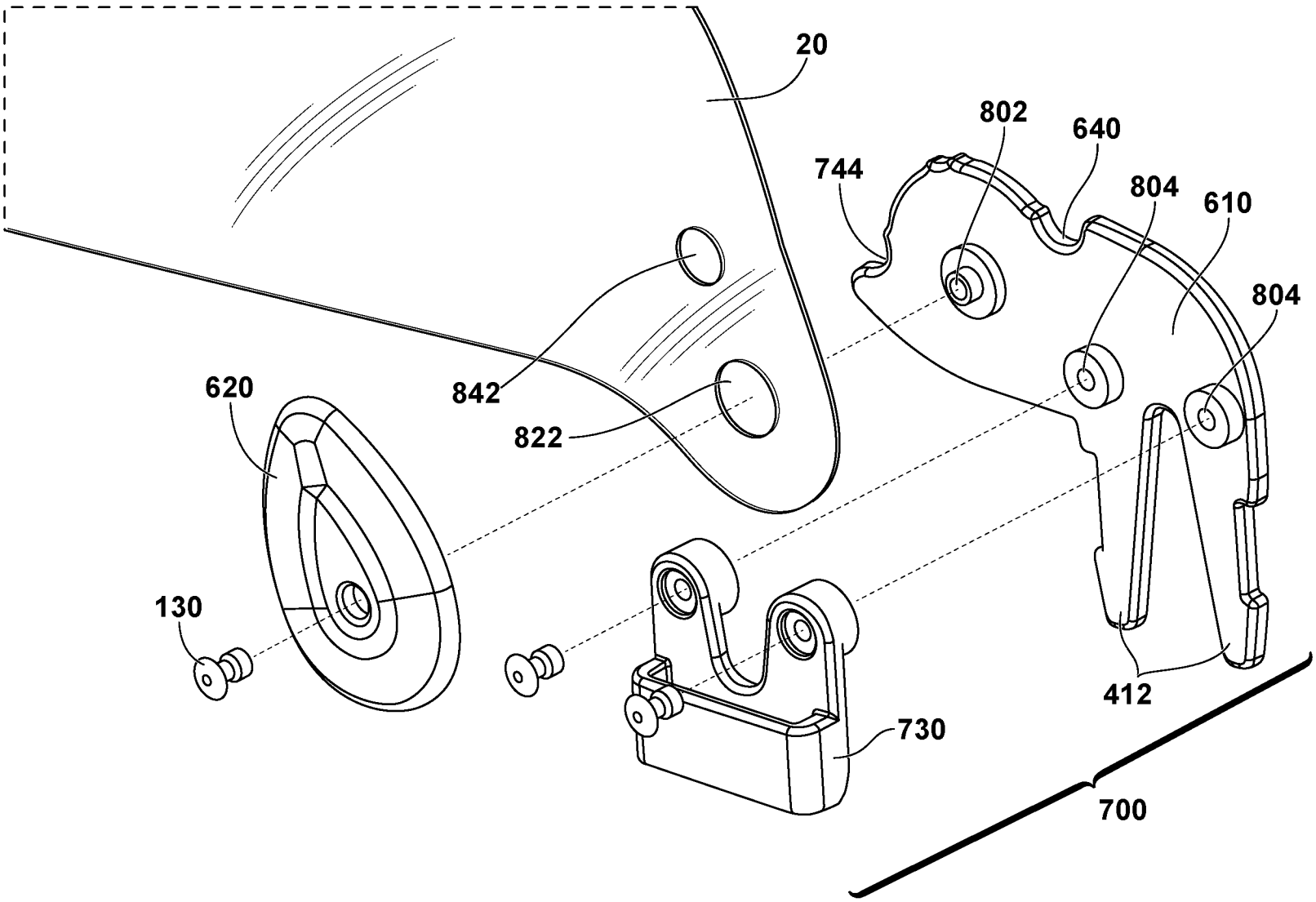
FIG. 8A illustrates an exploded view of the clip system, in accordance with some embodiments.
Figure 8B:
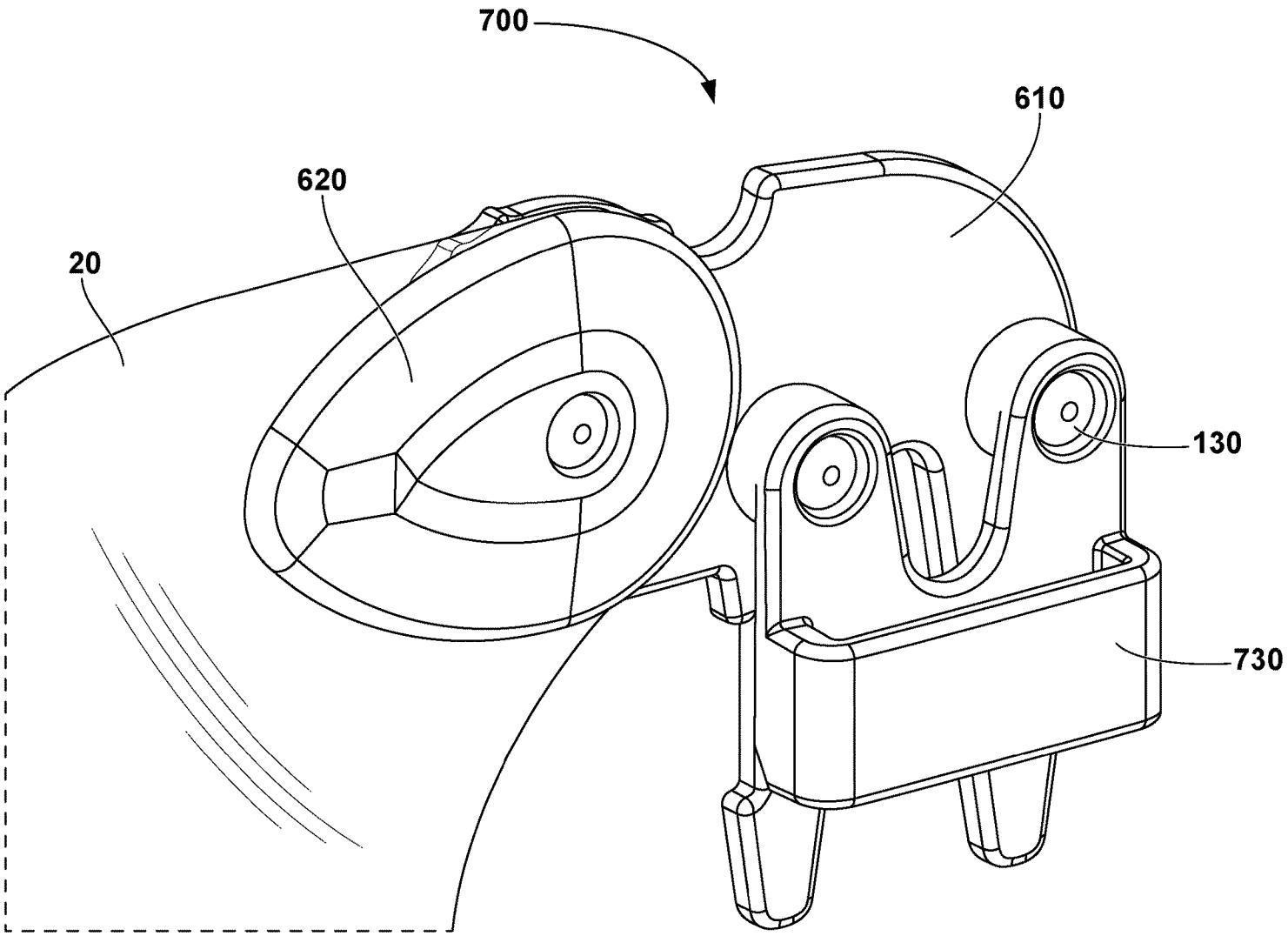
FIG. 8B shows the clip system connected to a visor, in accordance with some embodiments.
Figure 8C:
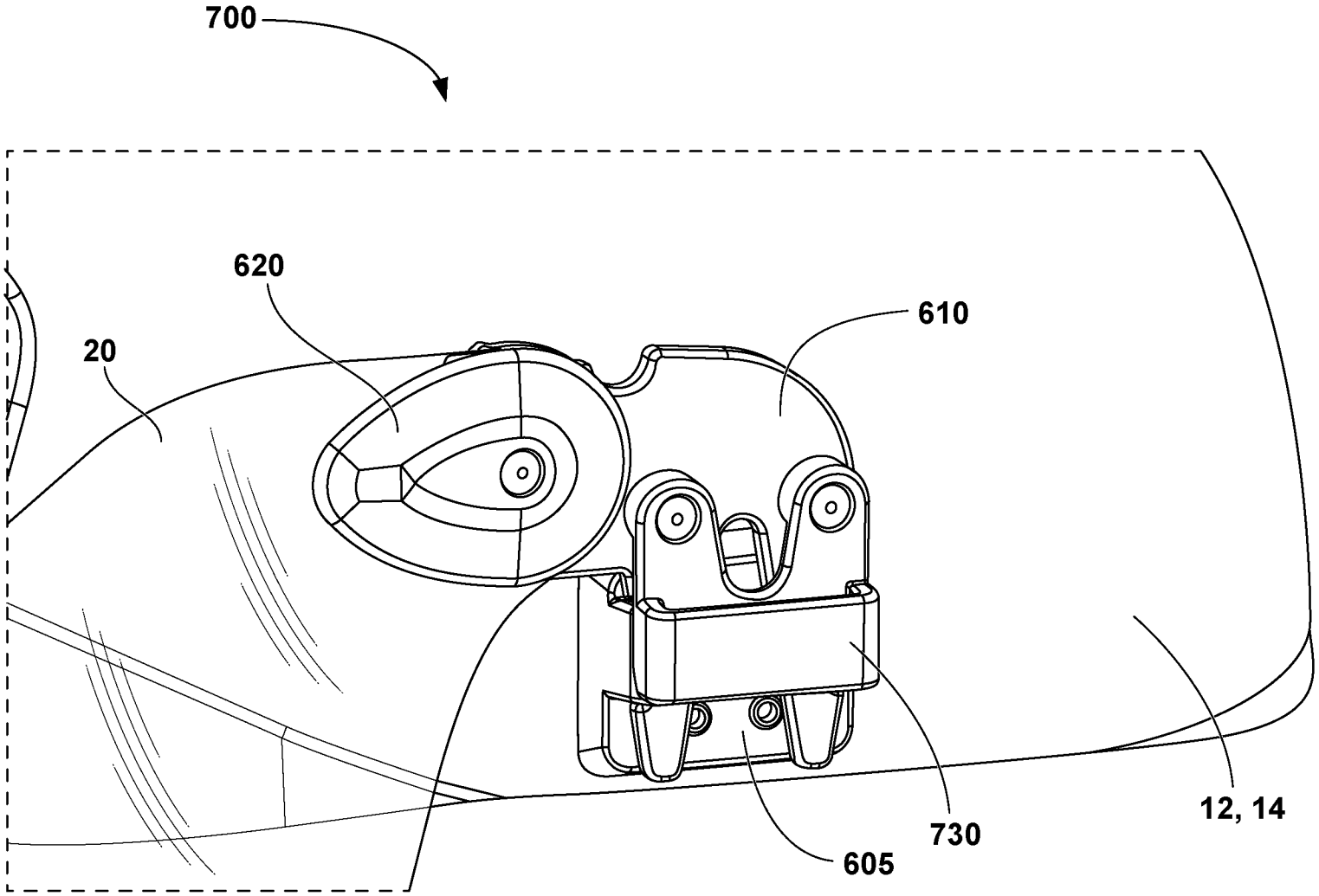
FIG. 8C shows the clip system and visor attached to an adaptor affixed to a bump cap, in accordance with some embodiments.
Figure 8D:
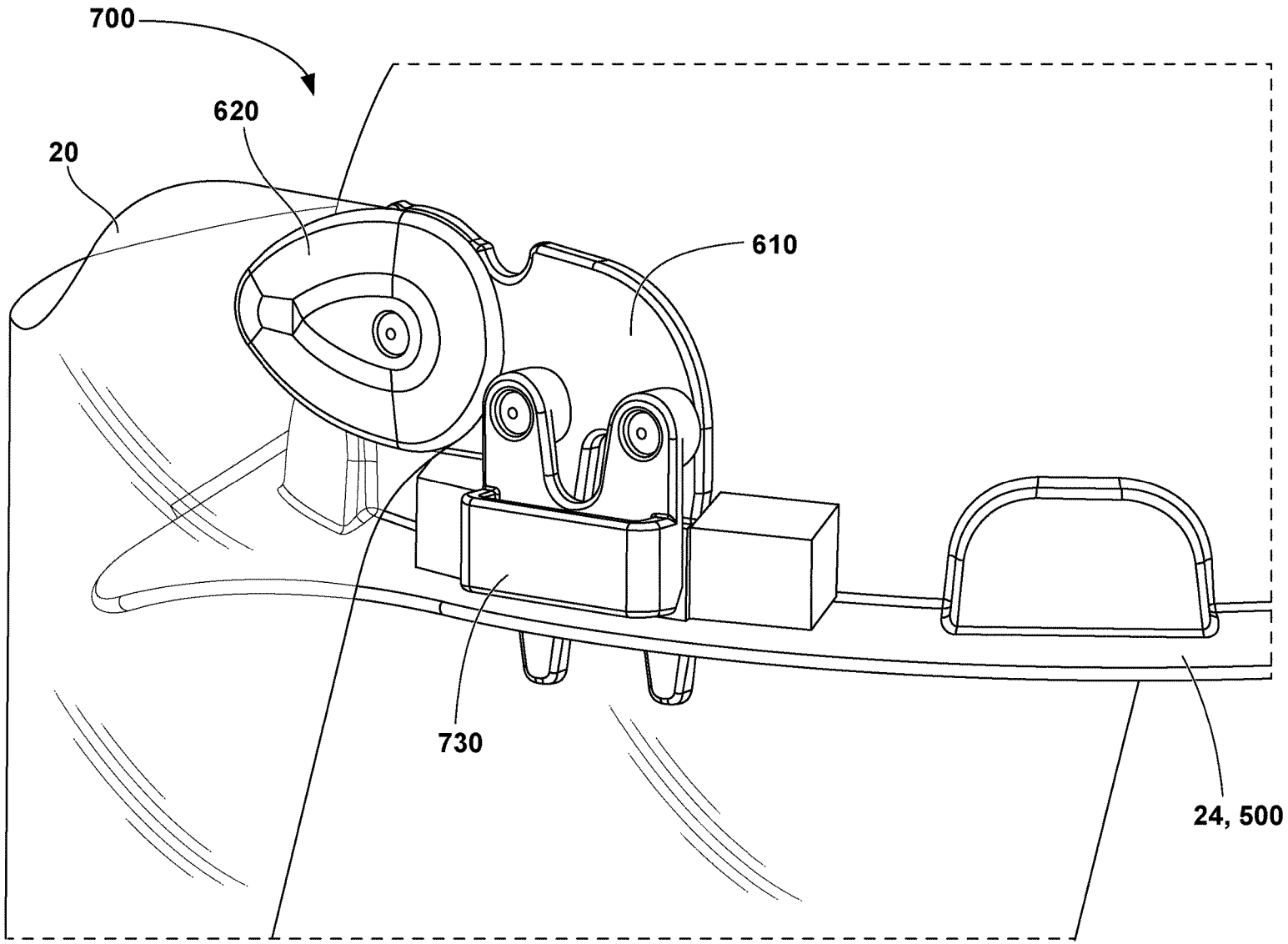
FIG. 8D shows the clip system and visor attached to a slot on a hard hat, in accordance with some embodiments.

FIG. 8A illustrates an exploded view of the clip system 700, in accordance with some embodiments. Rivet 130 will connect swivel joint 620 to the clip 610 through hole 822 on the visor 20 to rivet connector 802. Swivel pin 780 of swivel joint 620 will connect to visor 20 at hole 842. Swivel pin 780 may be used as a stopping mechanism for the rotation of the shield 20 at indentations 640 and 644. The additional adaptor 130 will connect to washer connectors 804 using rivets 130. FIG. 8B shows the clip system 700 connected to a visor 20, in accordance with some embodiments. FIG. 8C shows the clip system 700 and visor 20 attached to an adaptor 605 affixed to a bump cap 12, 14, in accordance with some embodiments. FIG. 8D shows the clip system 700 and visor 20 attached to a slot on a hard hat 24, 500, in accordance with some embodiments.

Figure 9A:
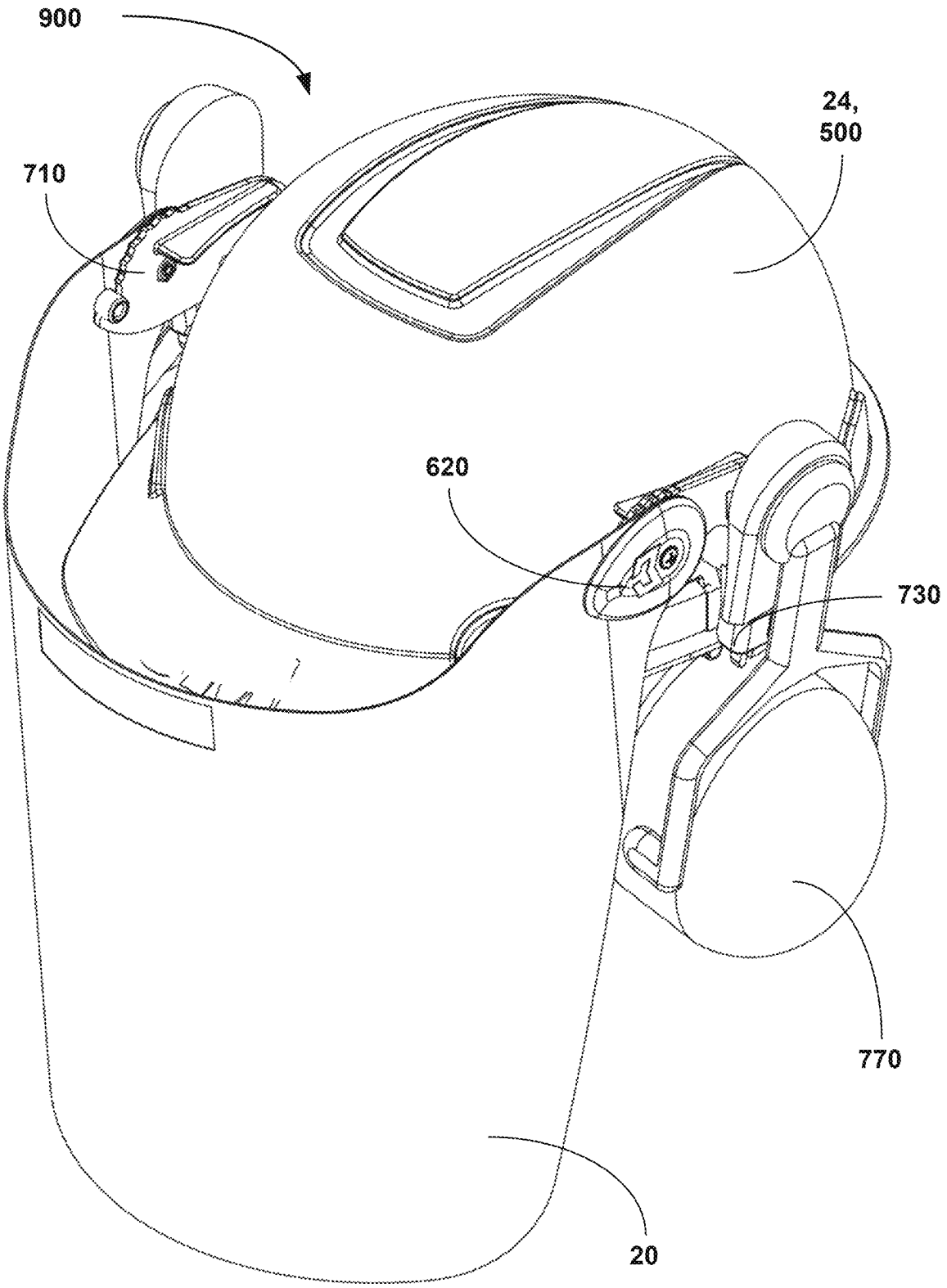
FIG. 9A illustrates, in an isometric view, an example of a hard hat assembly, in accordance with some embodiments.
Figure 9B:
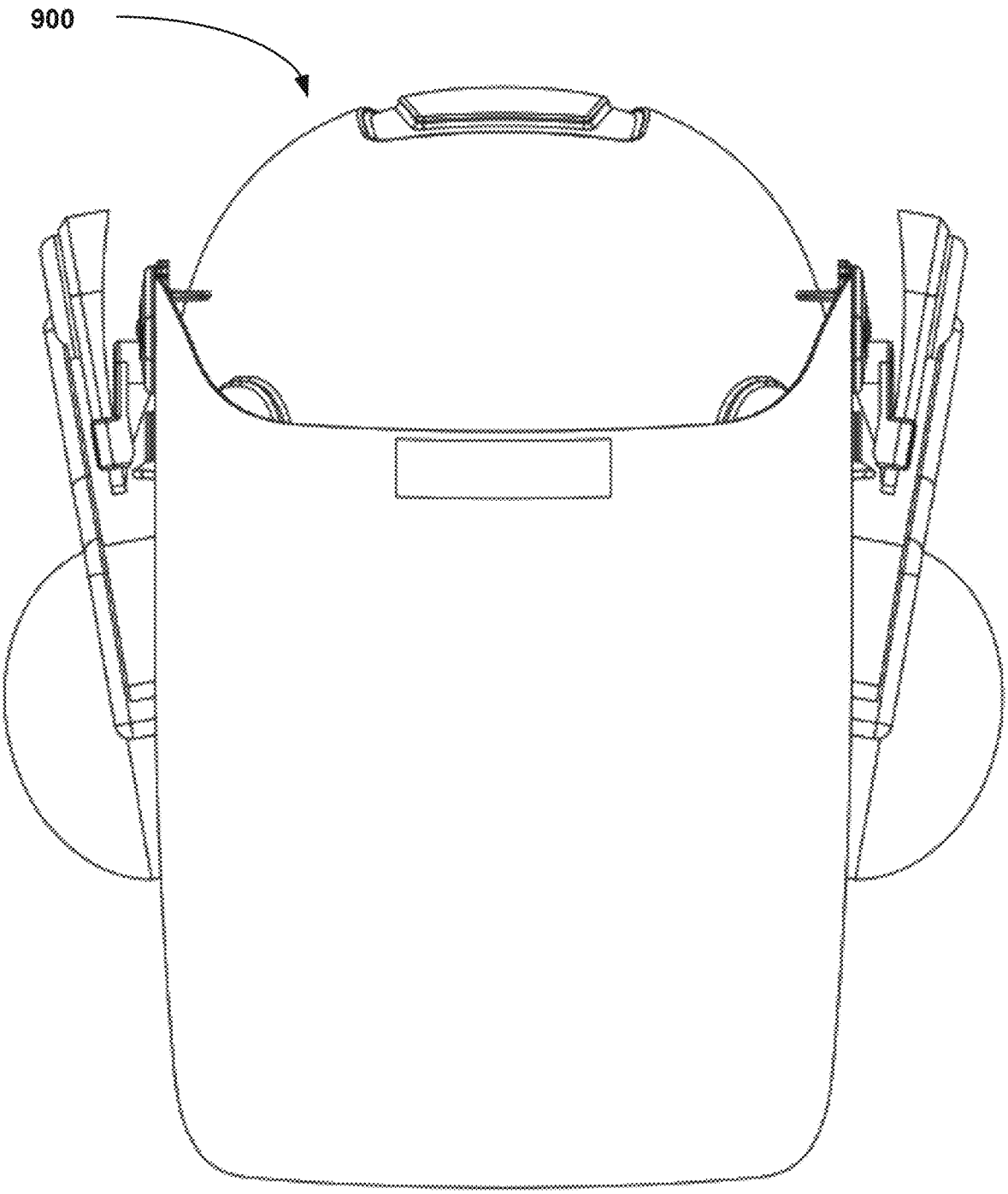
FIG. 9B illustrates, in a front view, the hard hat assembly, in accordance with some embodiments.
Figure 9C:
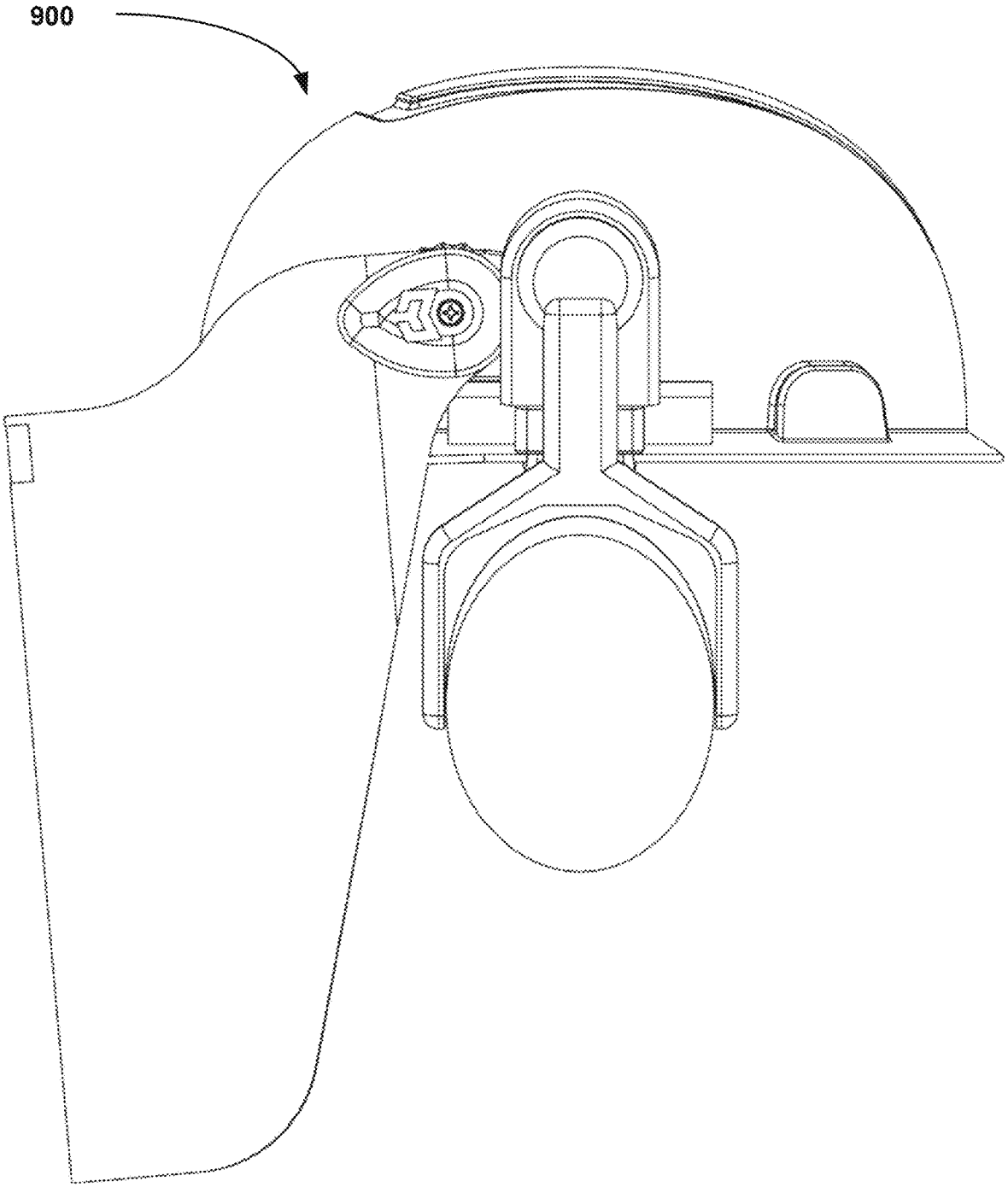
FIG. 9C illustrates, in a side view, the hard hat assembly, in accordance with some embodiments.
Figure 9D:
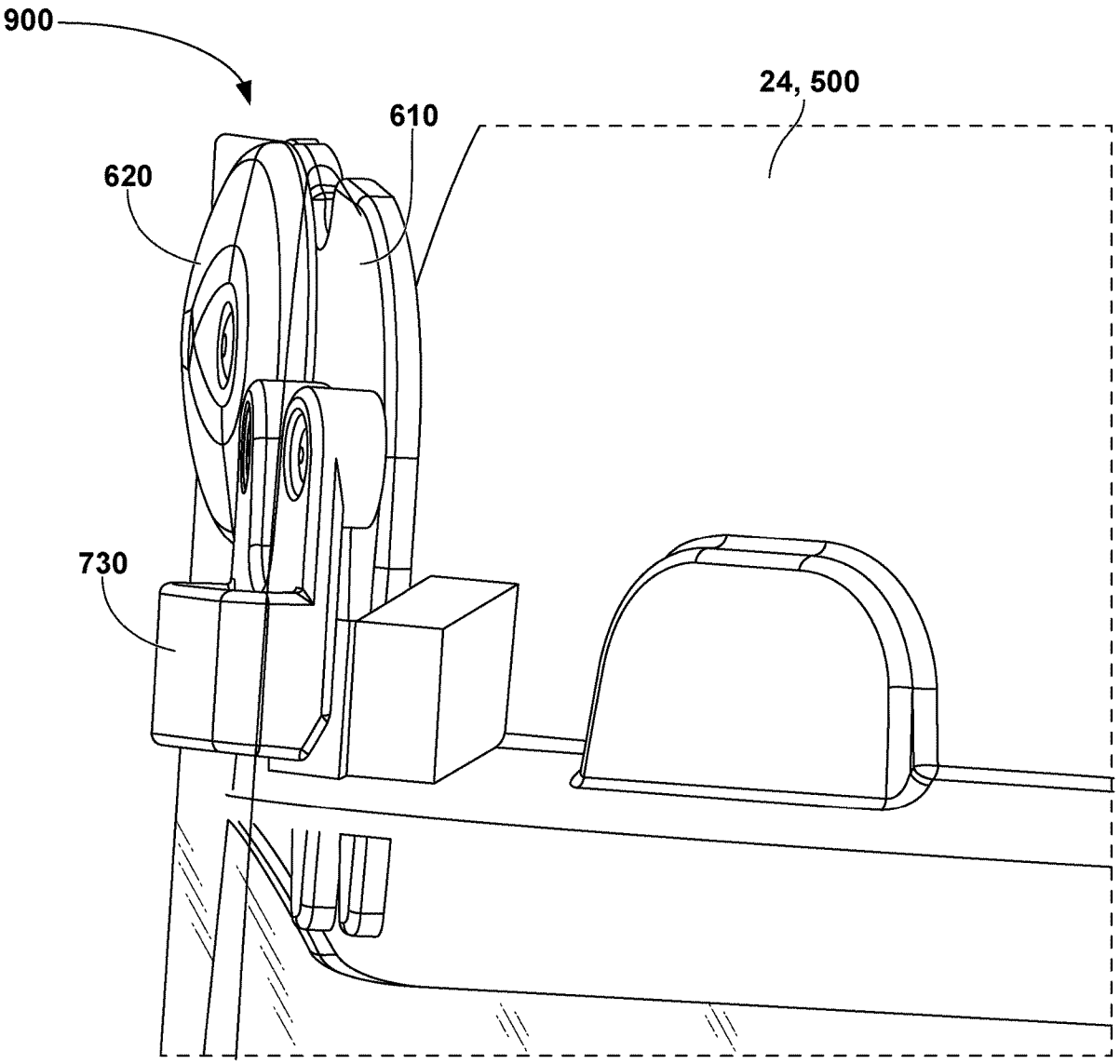
FIG. 9D shows the hard hat assembly from a rear view of the hard hat showing the clearance of the additional (e.g., earmuff) adaptor to the rim of the hard hat, in accordance with some embodiments.
Figure 9E:
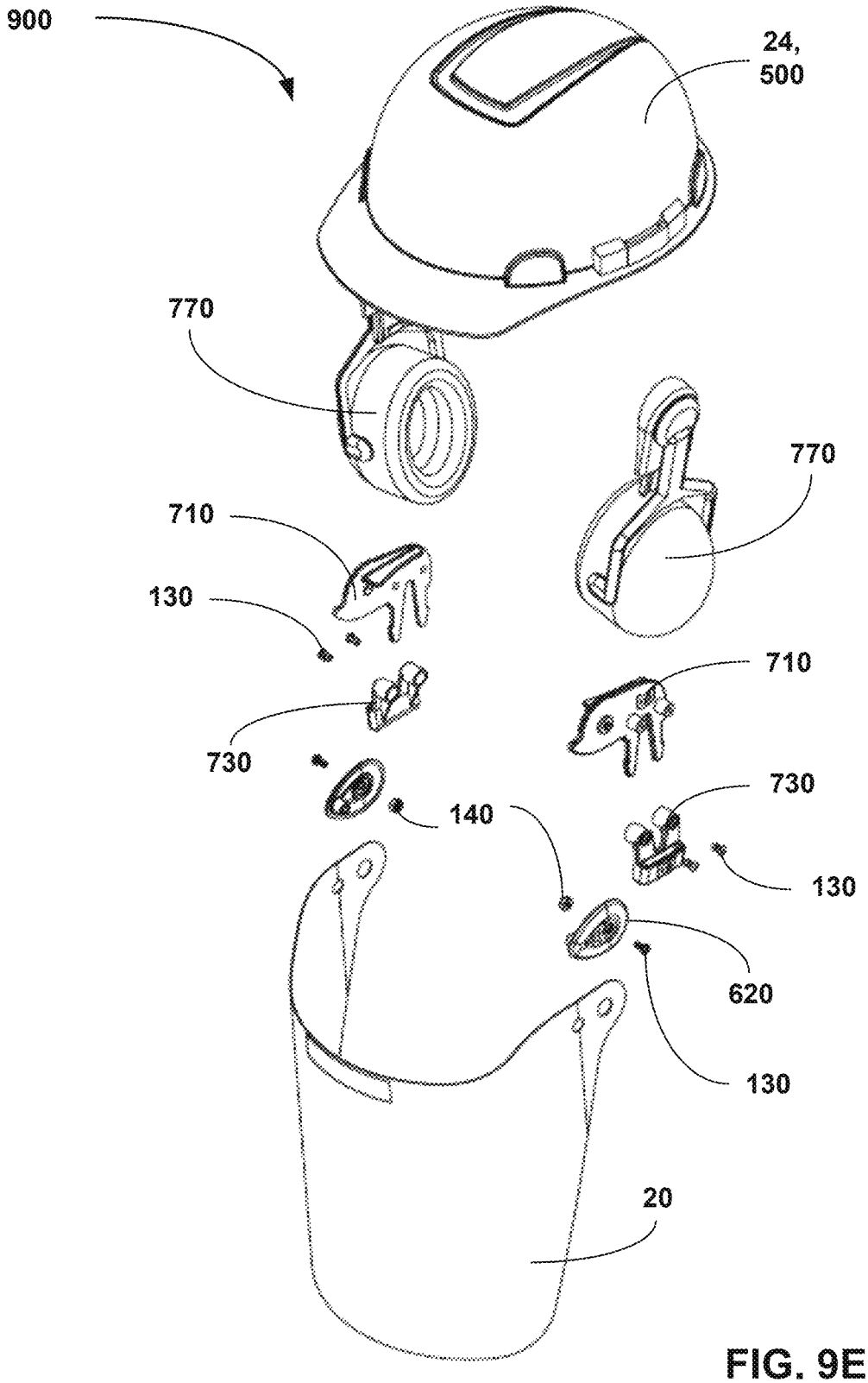
FIG. 9E illustrates, in an exploded view the components of the hard hat assembly, in accordance with some embodiments.
Figure 9F:
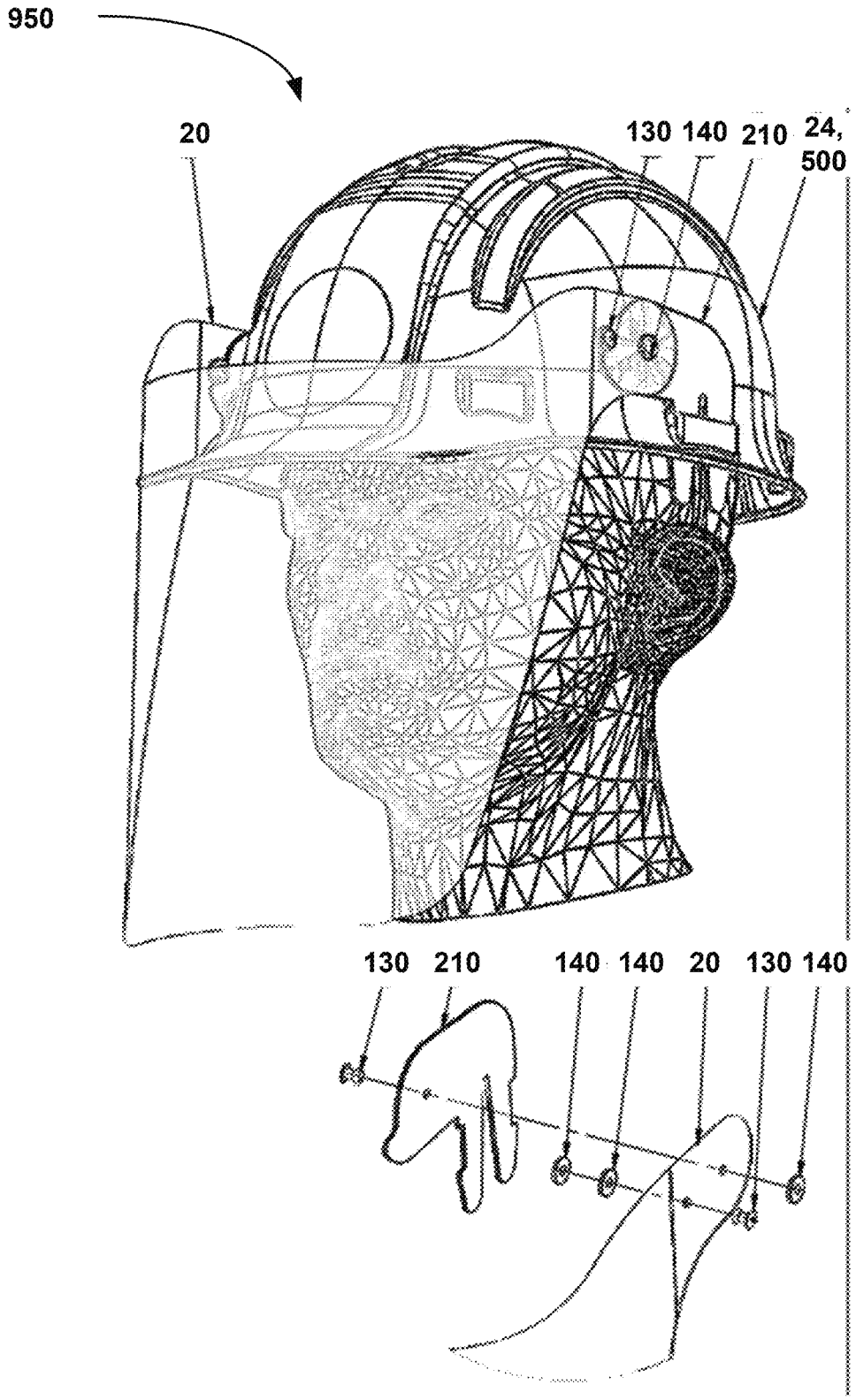
FIG. 9F illustrates another example of a hard hat assembly, in accordance with some embodiments.
Figure 9G:
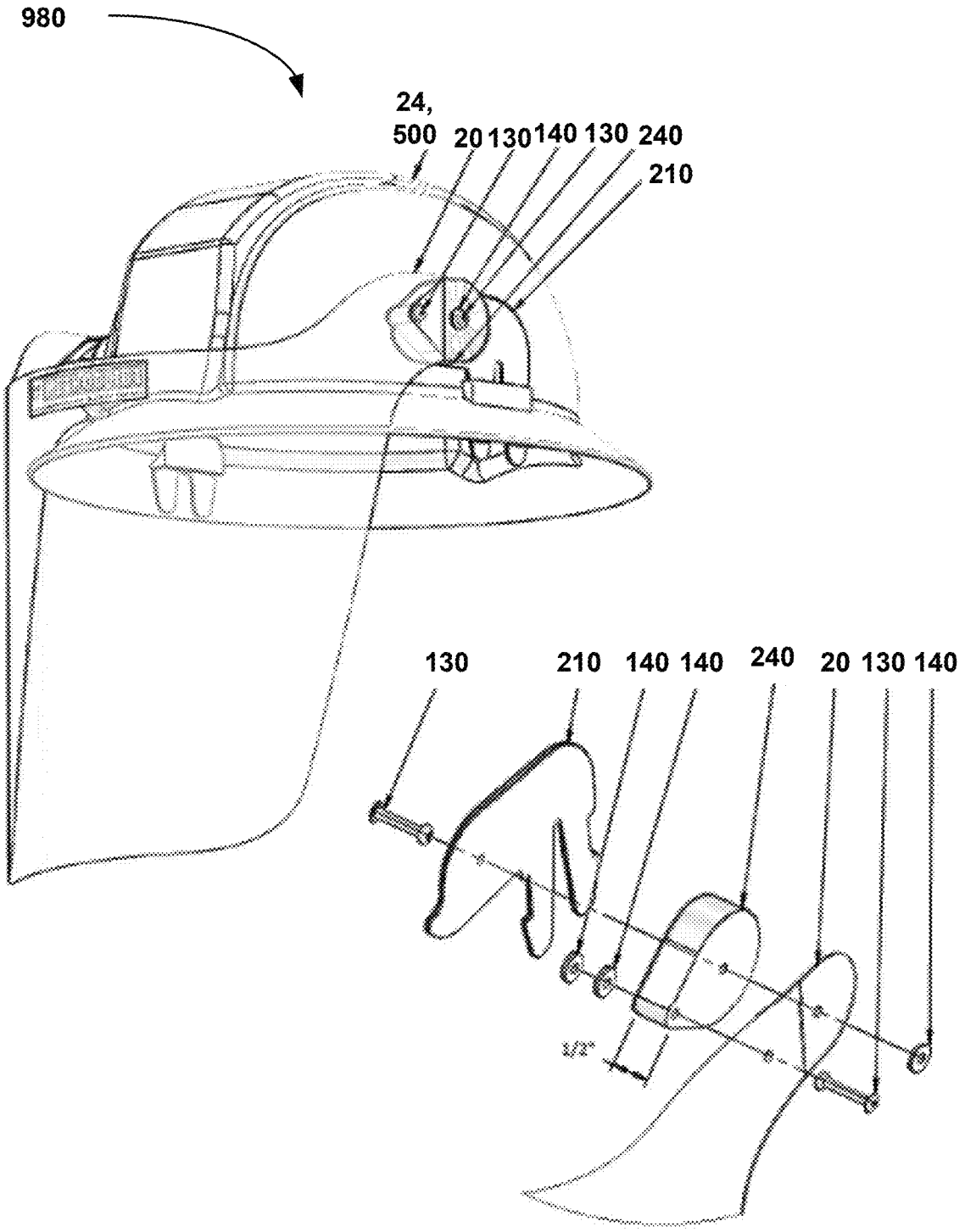
FIG. 9G illustrates another example of a hard hat assembly, in accordance with some embodiments.

FIG. 9A illustrates, in an isometric view, an example of a hard hat assembly 900, in accordance with some embodiments. The hard hat assembly 900 comprises a hard hat 24, 500, a clip system with clips 710 attached to corresponding slots at the side of the hard hat 24, 500, a face shield 20 attached to clip system via swivel joint 620, and earmuffs 770 attached to adaptor 730 attached to clip 710. FIG. 9B illustrates, in a front view, the hard hat assembly 900, in accordance with some embodiments. FIG. 9C illustrates, in a side view, the hard hat assembly 900. FIG. 9D shows the hard hat assembly 900 from a rear view of the hard hat 24, 500 showing the clearance of the additional (e.g., earmuff) adaptor 730 to the rim of the hard hat 24, 500, in accordance with some embodiments. It should be noted that in this configuration a spacer component 240 is not required. FIG. 9E illustrates, in an exploded view the components of the hard hat assembly 900, in accordance with some embodiments. FIG. 9F illustrates another example of a hard hat assembly 950, in accordance with some embodiments. Hard hat assembly 950 comprises a hard hat 24, visor 20, clip 210, a rivet 130 and washer 140 connecting the clip 210 to visor 20, and two washers 130 connected to visor 20 uses as a stopping means to prevent the visor 20 from rotating past either the "up" "or down" position. FIG. 9G illustrates another example of a hard hat assembly 980, in accordance with some embodiments. Hard hat assembly 980 adds a spacer component 240 between the visor 20 and the clip 210. The spacer component 240 is also between the visor 20 and the two stopping washers.

Figure 10A:
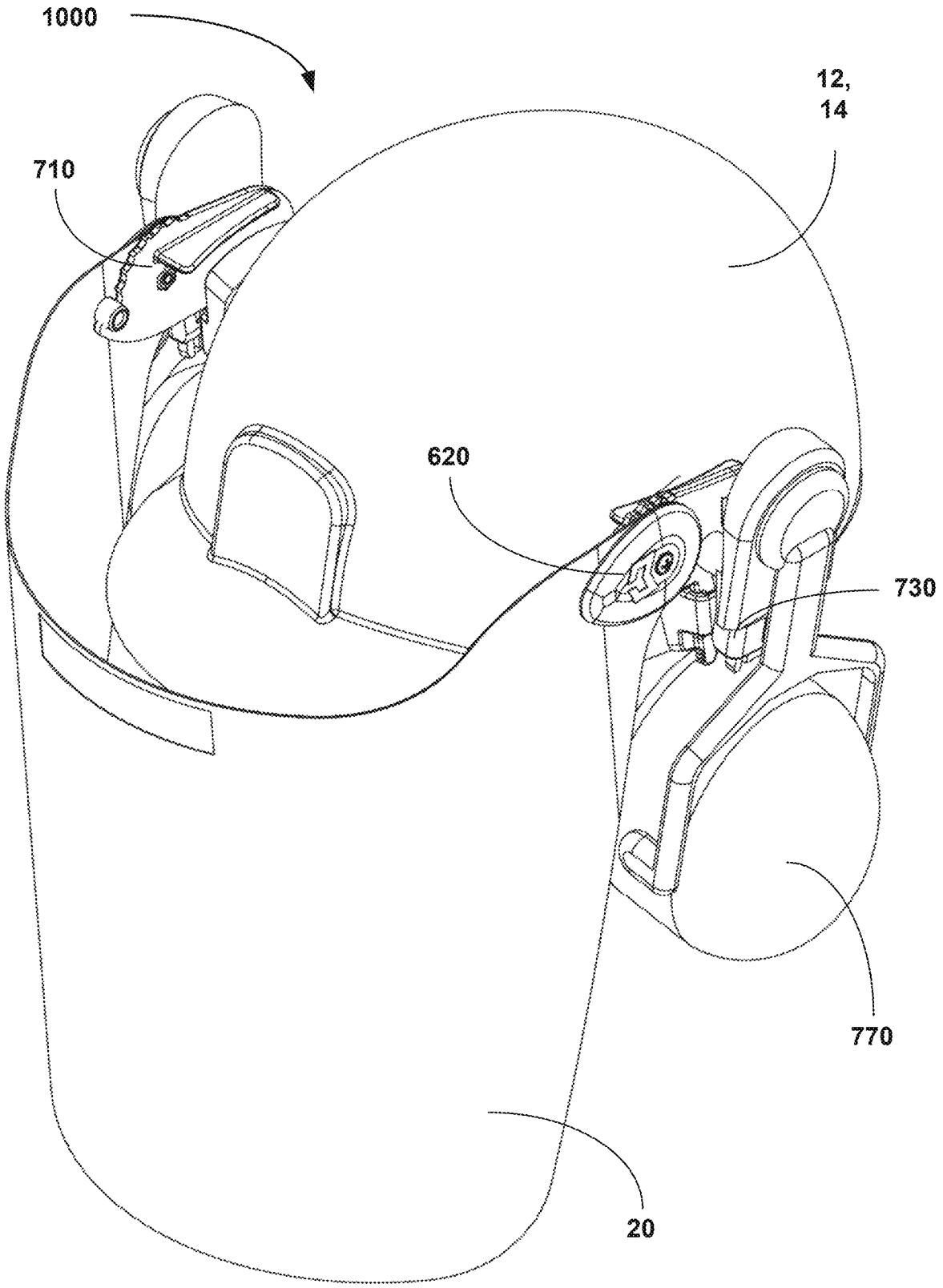
FIG. 10A illustrates, in an isometric view, an example of a bump cap assembly, in accordance with some embodiments.
Figure 10B:
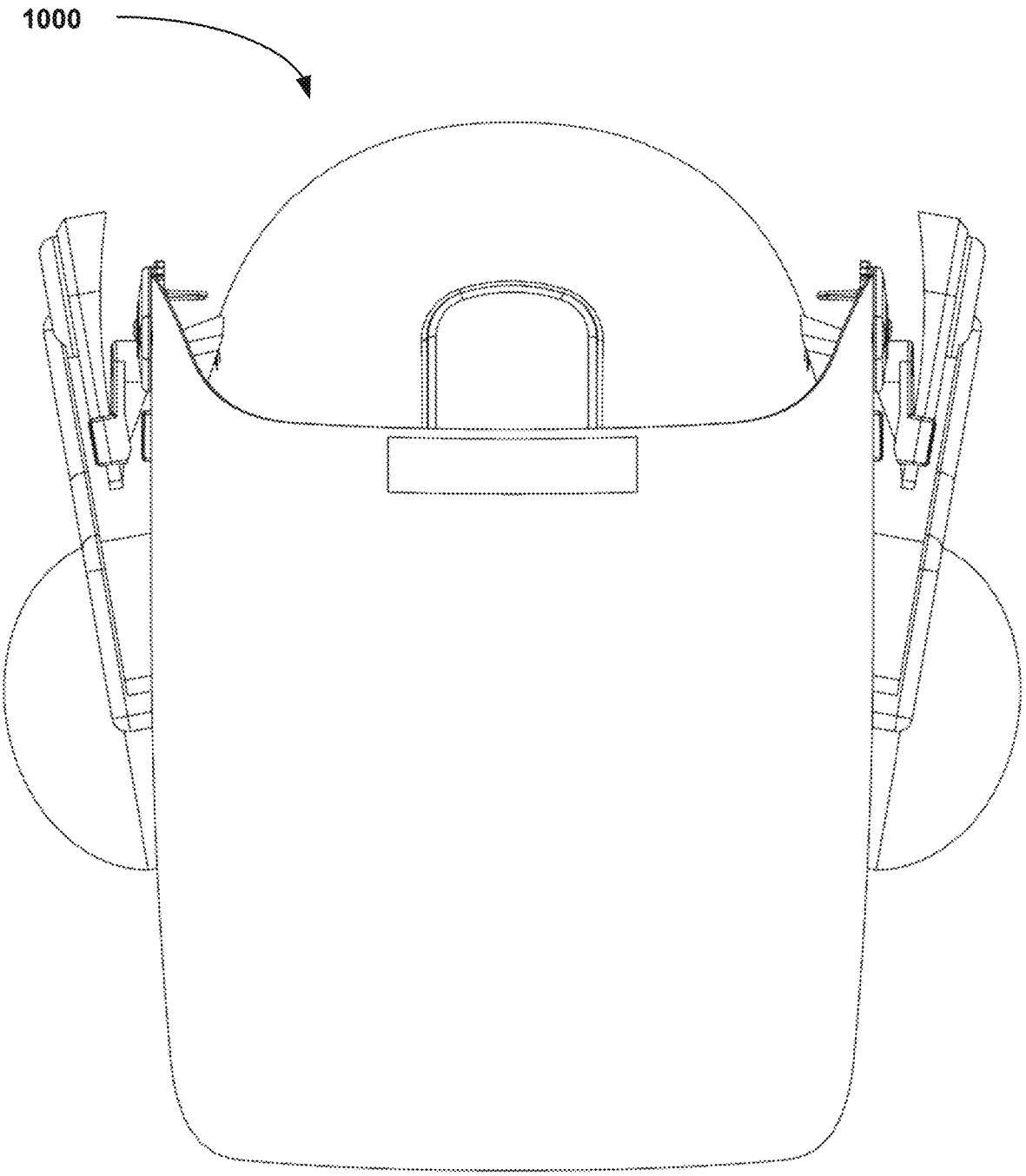
FIG. 10B illustrates, in a front view, the bump cap assembly, in accordance with some embodiments.
Figure 10C:
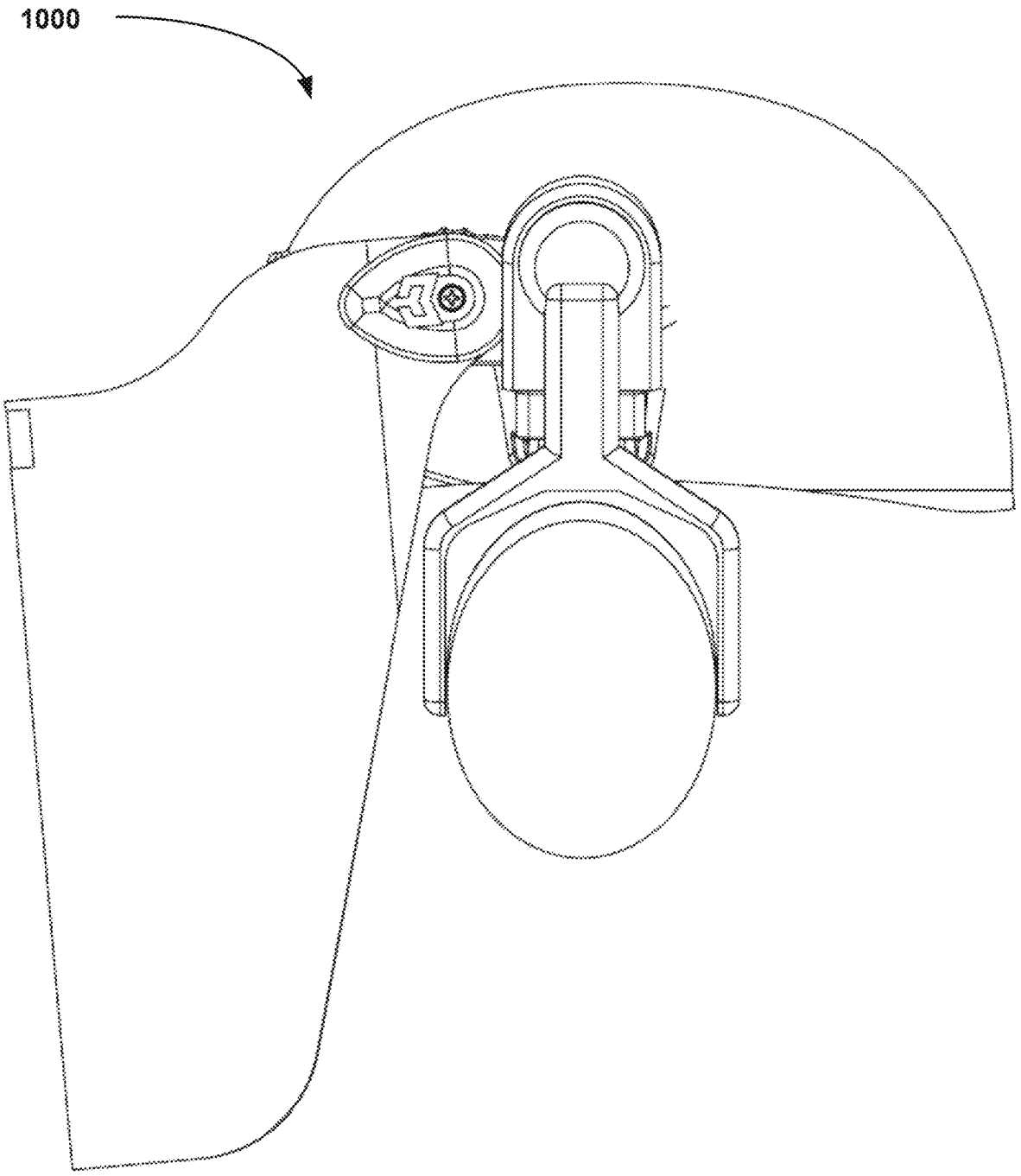
FIG. 10C illustrates, in a side view, the bump cap assembly.
Figure 10D:
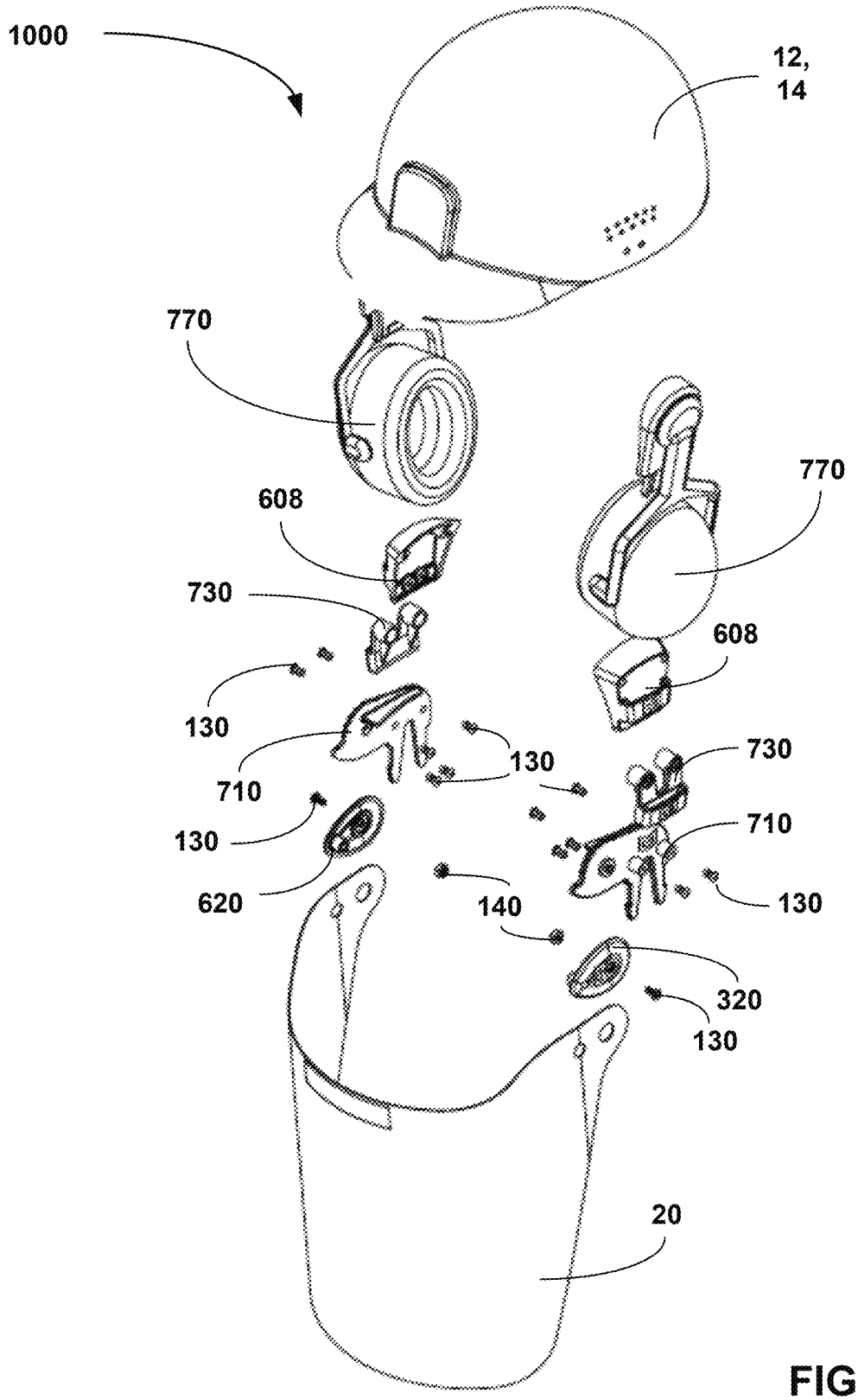
FIG. 10D illustrates, in an exploded view the components of the bump cap assembly 1000, in accordance with some embodiments.
Figure 10E:
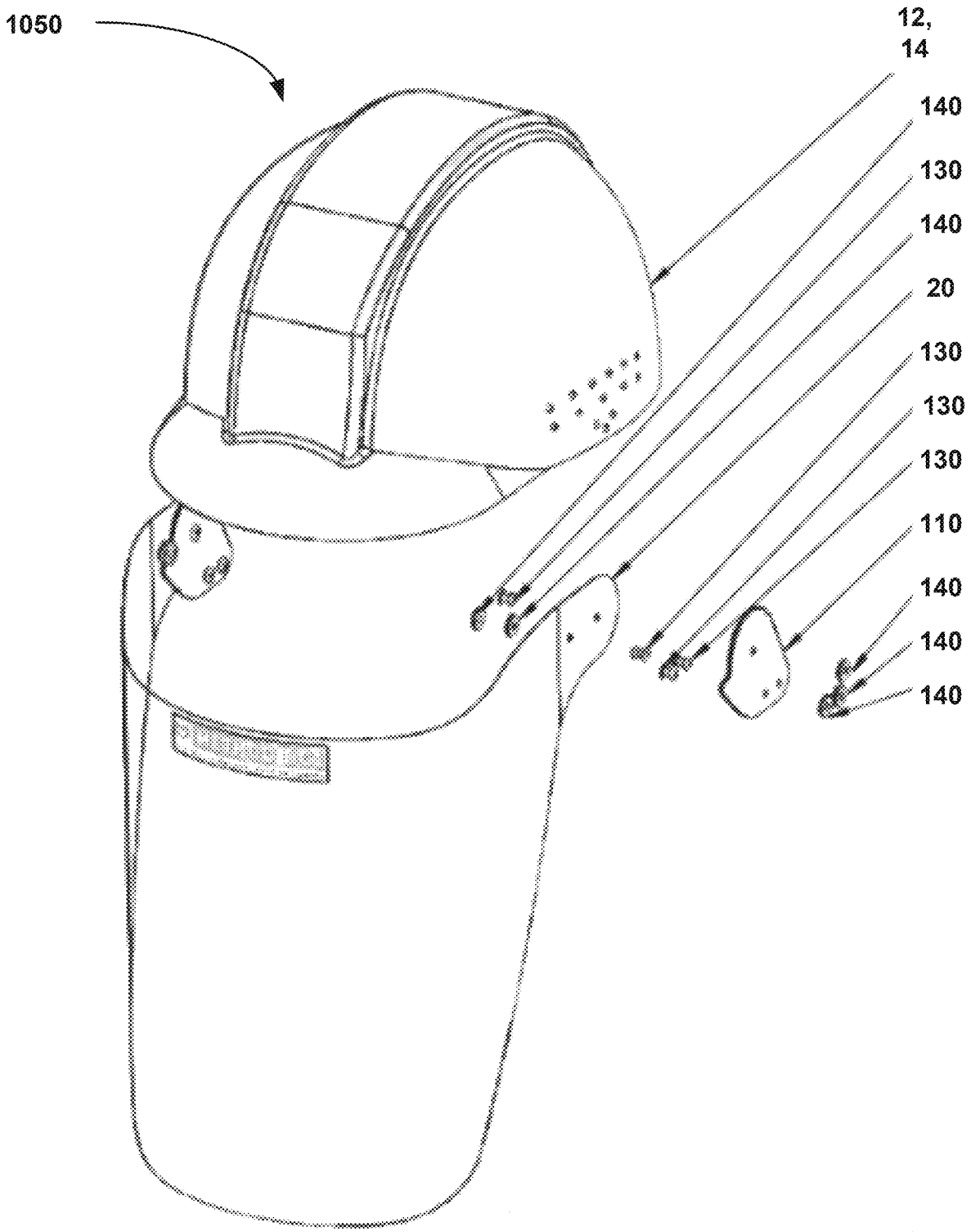
FIG. 10E illustrates another example of a bump cap assembly, in accordance with some embodiments.

FIG. 10A illustrates, in an isometric view, an example of a bump cap assembly 1000, in accordance with some embodiments. The bump cap assembly 1000 comprises a bump cap 12, 14, a clip system with clip 710 attached to adaptor 600 attached to the bump cap 12, 14, a face shield 20 attached to clip system via swivel joint 620, and earmuffs 770 attached to earmuff adaptor 730 attached to clip 710. FIG. 10B illustrates, in a front view, the bump cap assembly 1000, in accordance with some embodiments. FIG. 10C illustrates, in a side view, the bump cap assembly 1000. FIG. 10D illustrates, in an exploded view the components of the bump cap assembly 1000, in accordance with some embodiments. An alternative adaptor 608 is shown. FIG. 10E illustrates another example of a bump cap assembly 1050, in accordance with some embodiments. Bump cap assembly 1050 comprises a bump cap 12, 14, a clip system with clip 110 attached to bump cap 12, 14, and a face shield 20 attached to clip 110.

In some embodiments, components may be added to the cap assemblies to better hold accessories in place. For example, bolts may be added to better hold e-clips (or ear muff clips) in place. Such bolts are named herein as accessory-receiving adaptors, u-clips or u-bolts. These terms are used herein interchangeably.

Figure 11A:
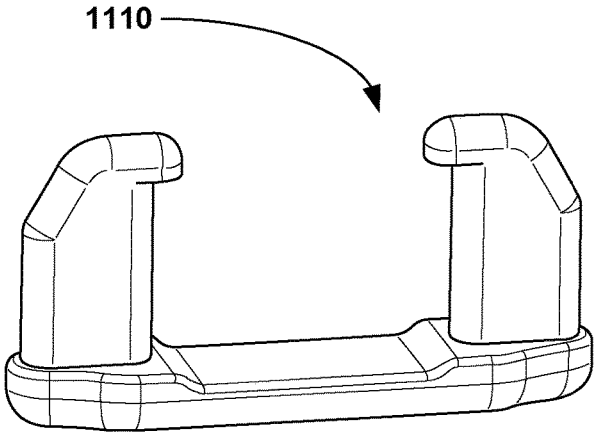
FIGS. 11A to 11C illustrate examples of accessory-receiving adaptors, in accordance with some embodiments.
Figure 11B:
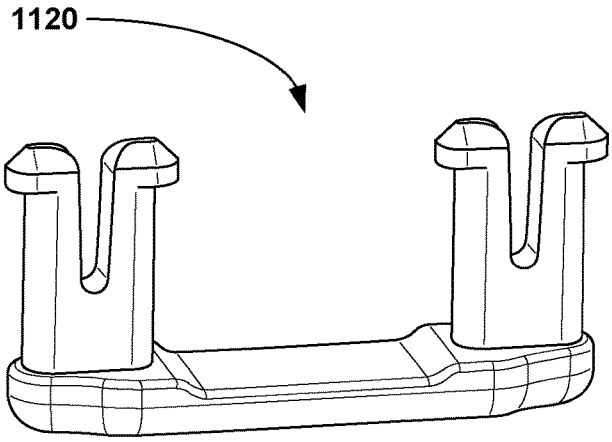
Figure 11C:
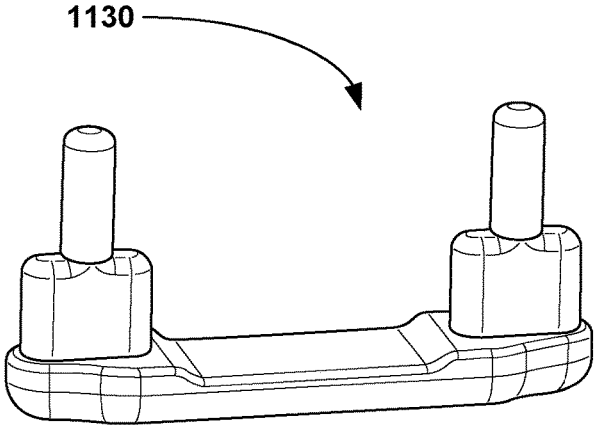

FIGS. 11A to 11C illustrate examples of U-bolts 1110, 1120, 1130, in accordance with some embodiments. The U-bolt 1110 of FIG. 11A locks on the inside of slotted holes or recesses added to an e-clip (or ear muff clip). The U-bolt 1120 of FIG. 11B locks on the inside and outside of slots added to the e-clip (or ear muff clip). The U-bolt 1130 of FIG. 11C allows for simpler mold modifications. Pins 1132 may be pushed into a round pin hole in an e-clip (or ear muff clip) and held with an engagement friction (or friction fit or interference fit) and/or pressure (or residual stresses). The slotted portion locks the tabs from flexing inwards.

Figure 12:
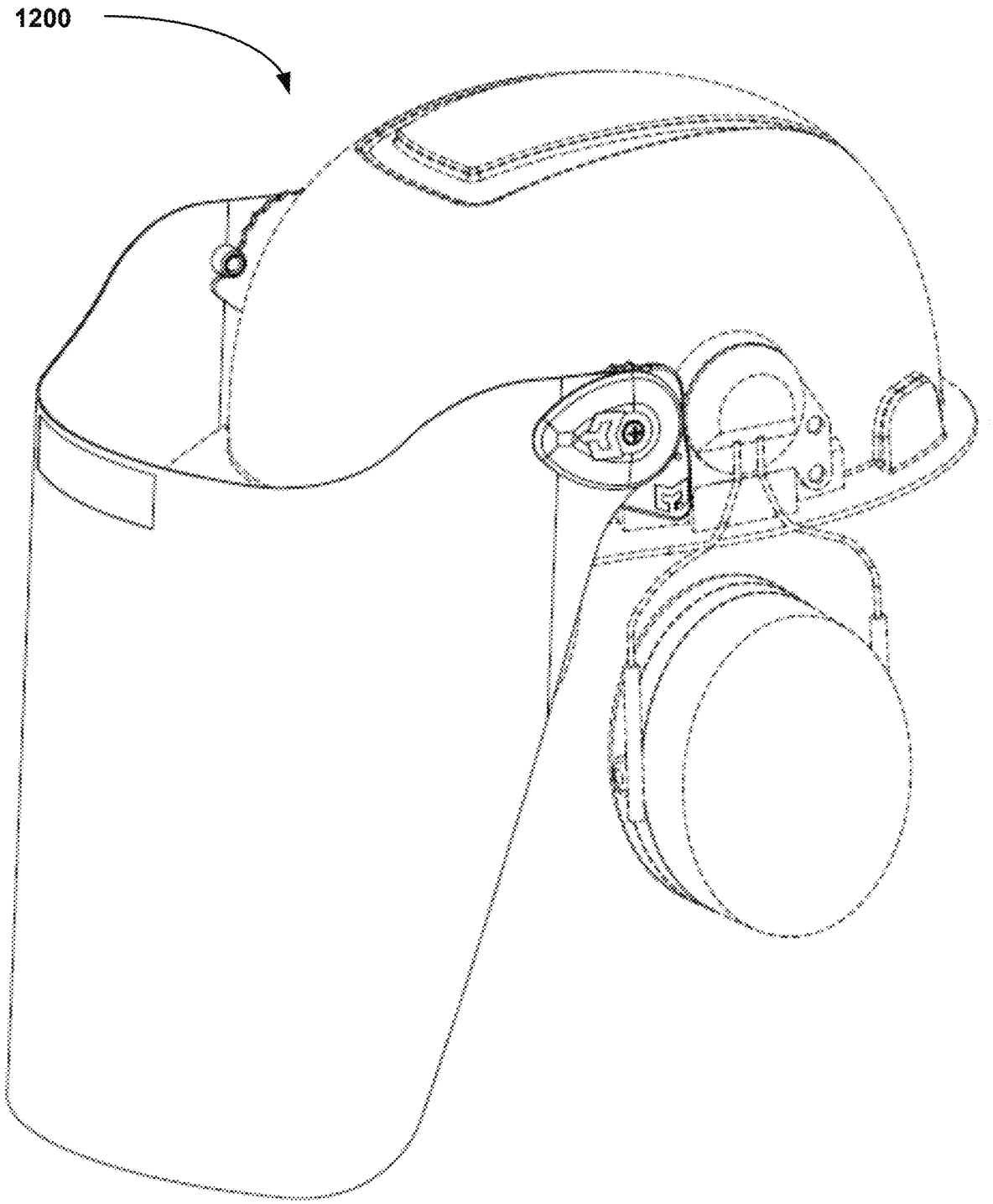
FIGS. 12, 14 and 16 illustrate examples of cap and face shield assemblies, including accessory-receiving adaptors, in accordance with some embodiments.
Figure 14:
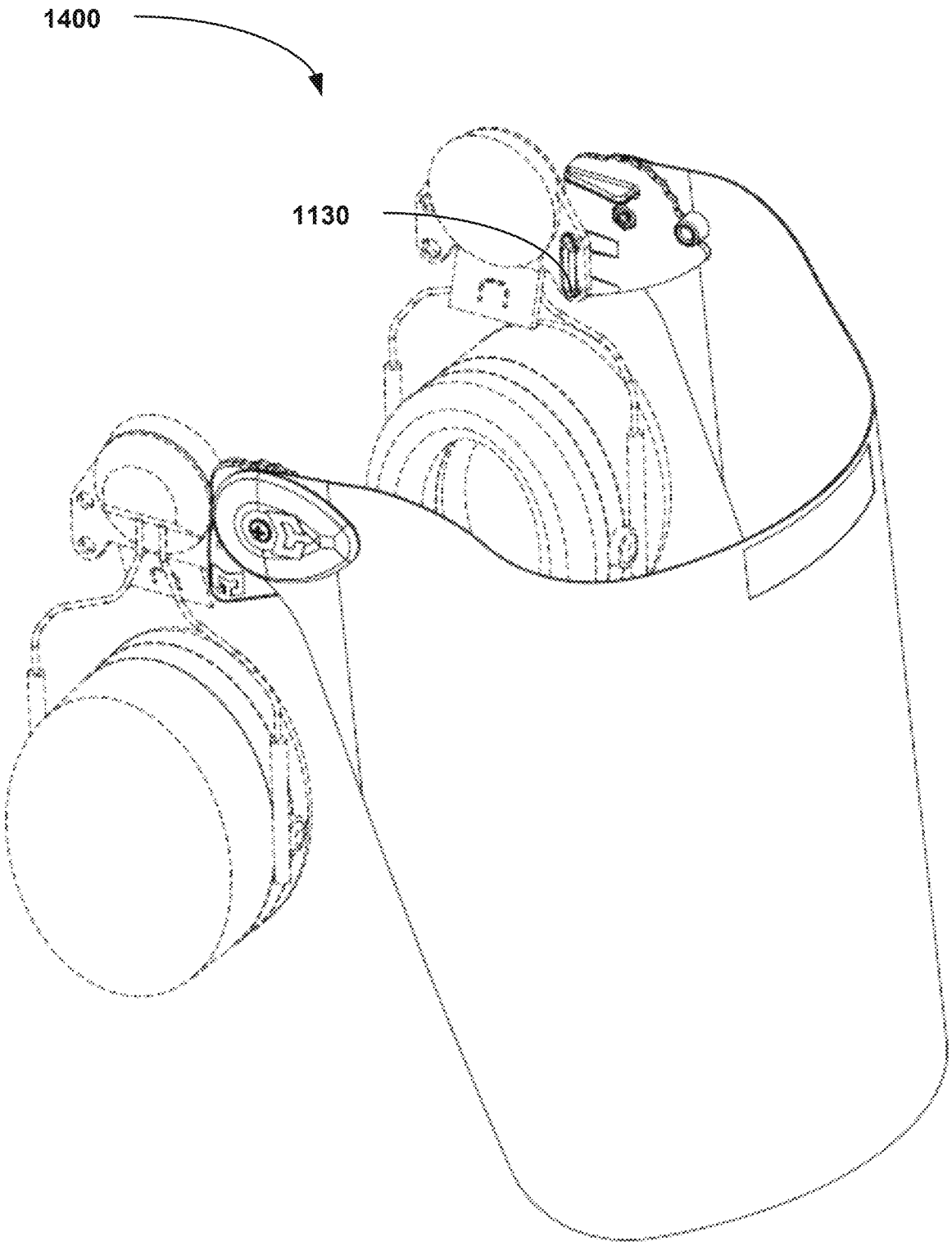
Figure 16:
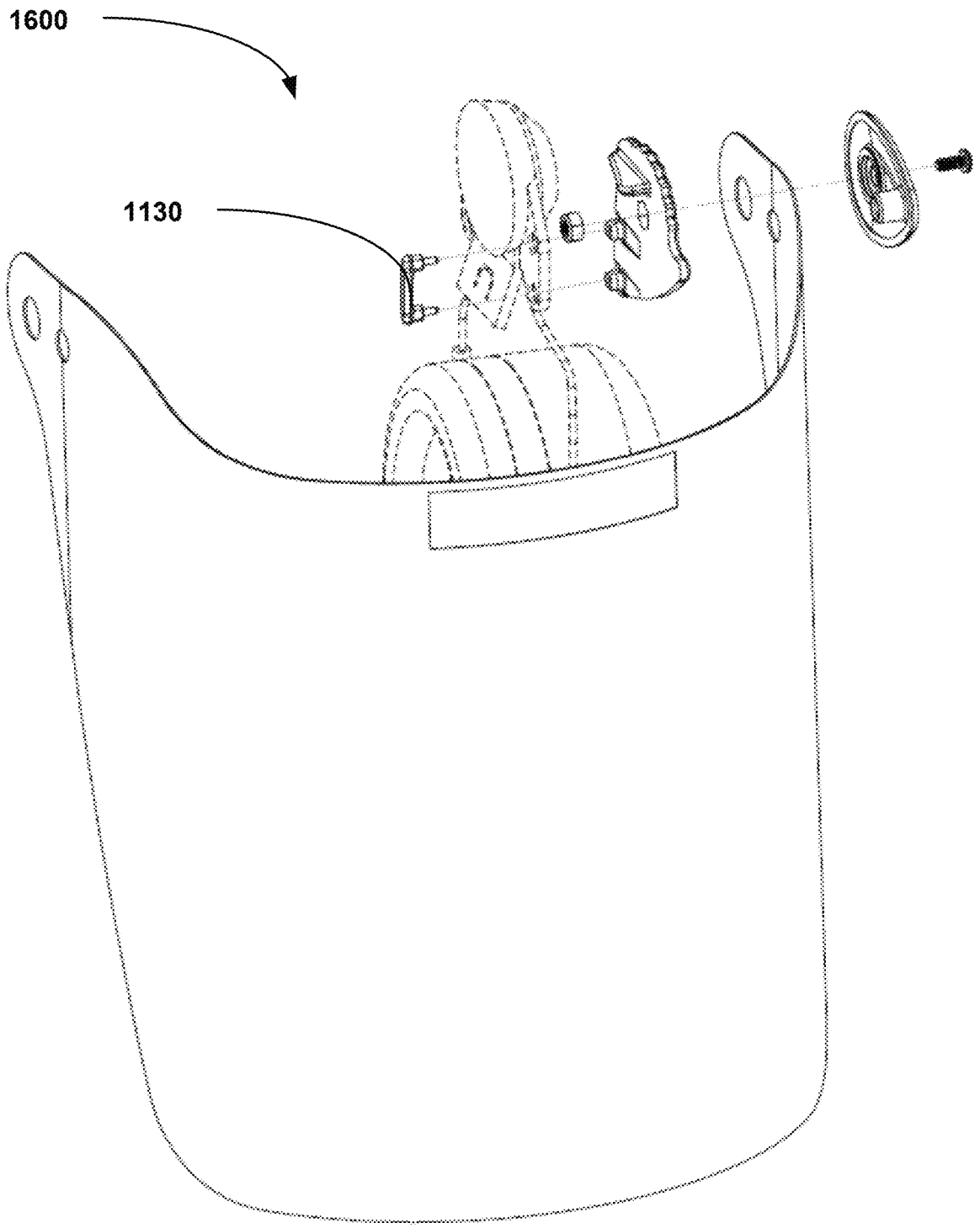

FIGS. 12, 14 and 16 illustrate examples of cap and face shield assemblies 1200, 1400, 1600, including U-bolts, in accordance with some embodiments. While the U-bolt 1130 is shown, it should be understood that other variations of the U-bolt 1130, or other U-bolts 1110, 1120, may be used.

Figure 13:
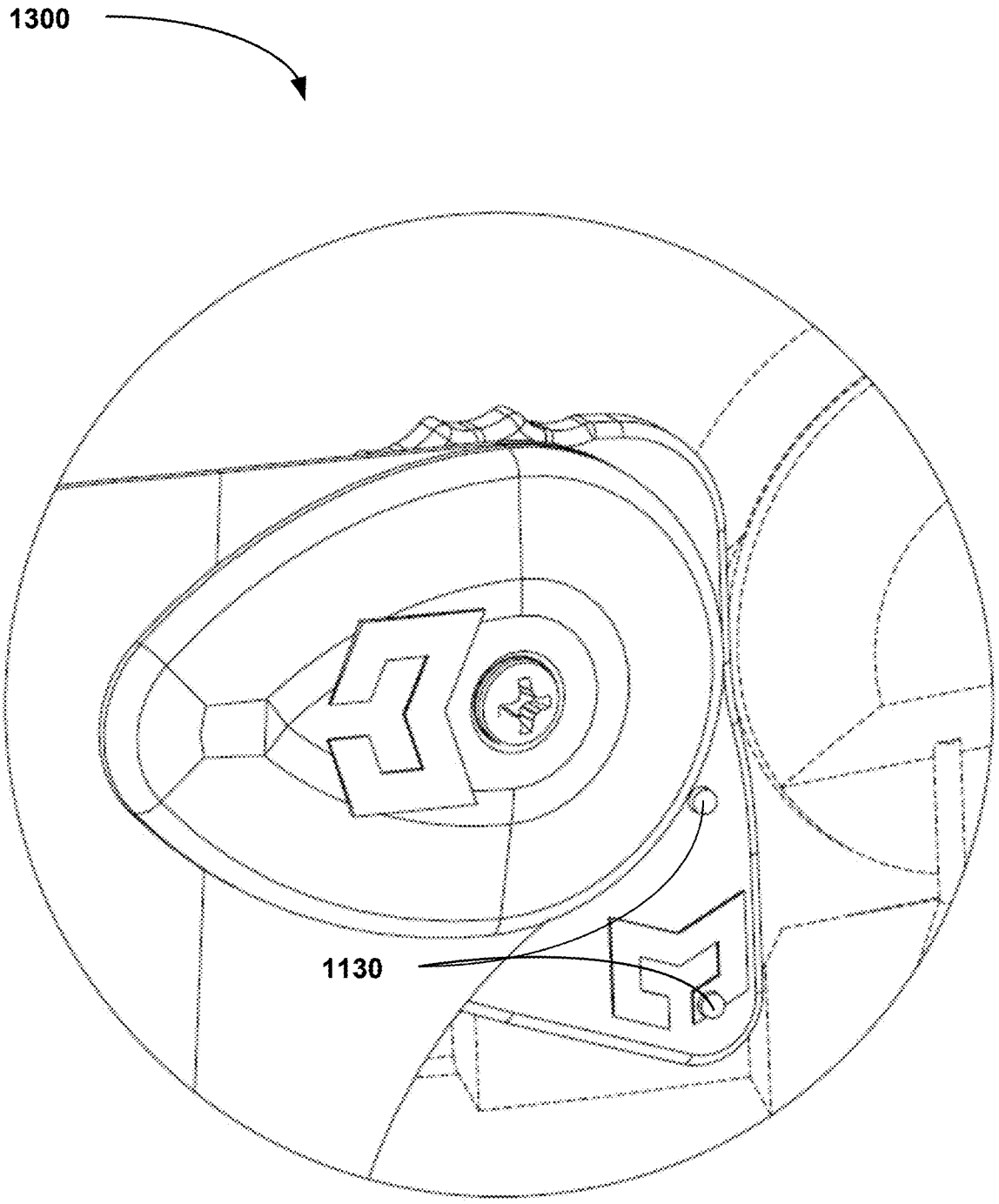
FIGS. 13 and 15 illustrate examples of the accessory-receiving adaptors engaging with the component-receiving adaptors, in accordance with some embodiments.
Figure 15:
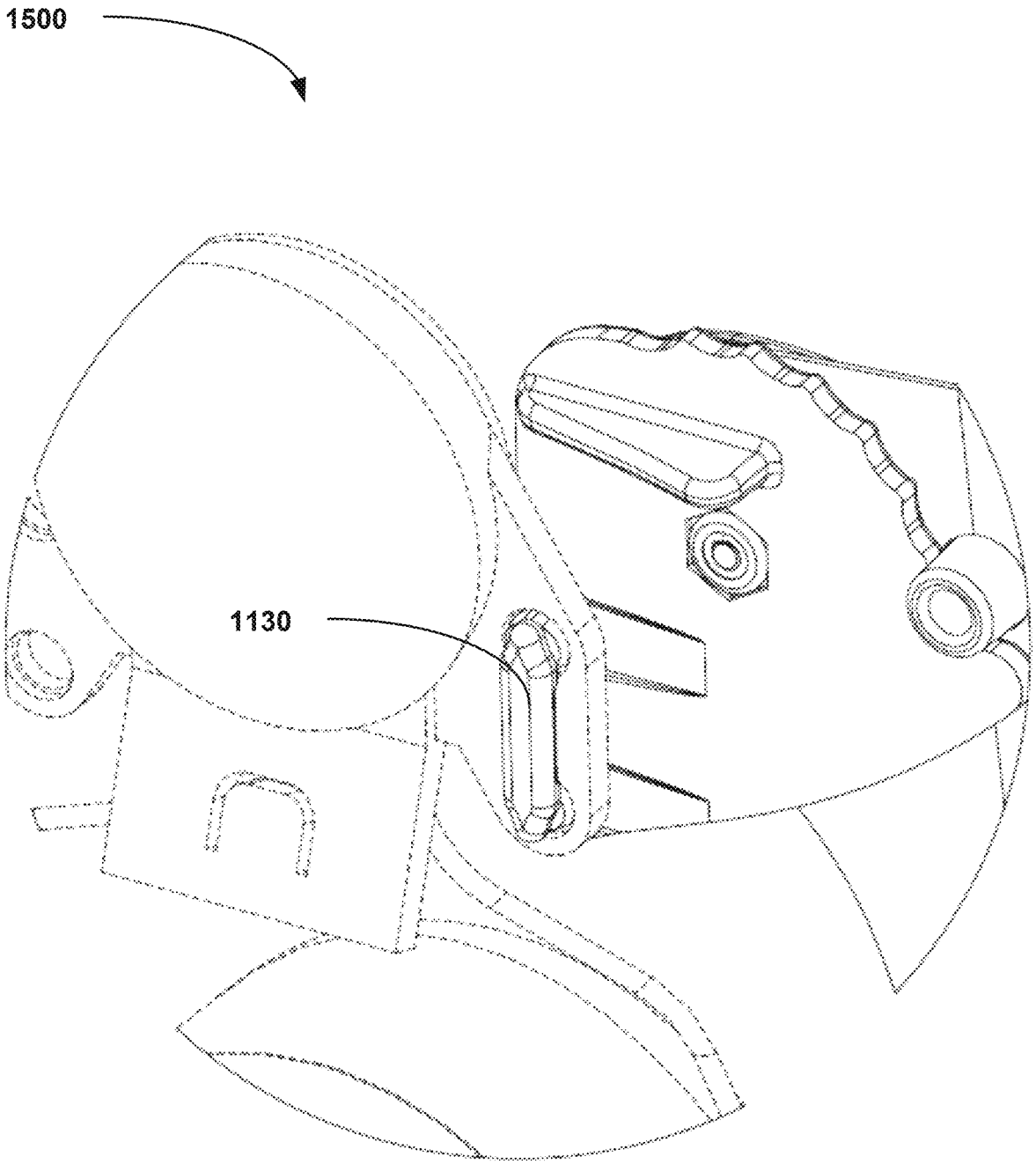

FIGS. 13 and 15 illustrate examples of the accessory-receiving adaptors engaging with the component-receiving adaptors, in accordance with some embodiments. In some embodiments, the U-bolts allow for a system of keeping sets of small legs that are molded at the back of e-clips well separated once a u-clip (or U-bolt) is installed. FIGS. 13 and 15 also show how the U-bolts may be used to prevent the e-clips from inadvertently detaching from the ear muffs. The small split legs at the back of the e-clips that are snapping into the holes of the ear muff together with the u-clips (or U-bolts) forcing the split legs to stay apart. The placement of a U-bolt securely between a hard cap and an e-clip holds the U-bolt in place.

Figure 17:
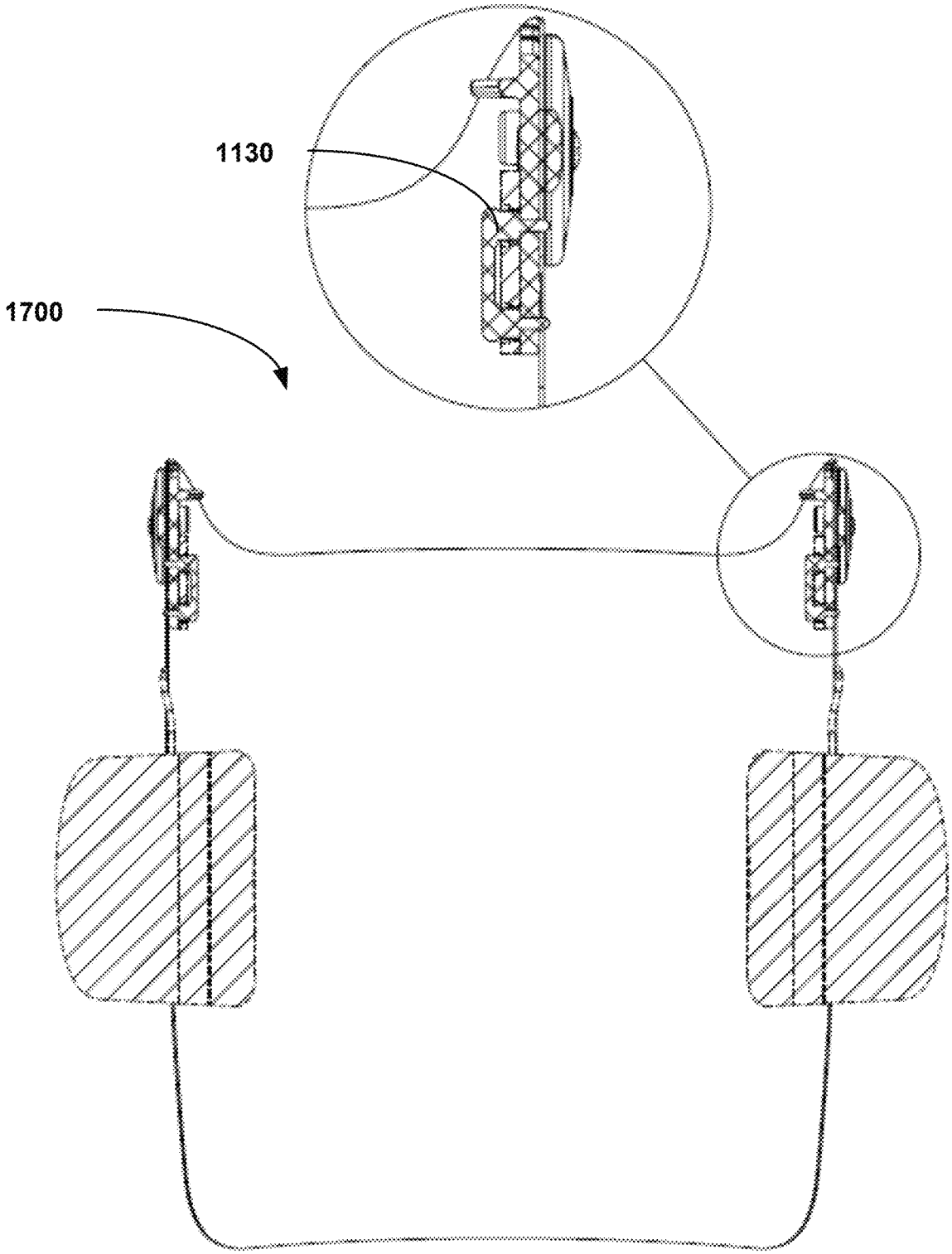
FIG. 17 illustrates how the accessory-receiving adaptor 1110, 1120, 1130 may hold ear muffs to an e-clip attached to a face shield, in accordance with some embodiments.

FIG. 17 illustrates how the accessory-receiving adaptor 1110, 1120, 1130 may hold ear muffs to an e-clip attached to a face shield, in accordance with some embodiments.

Figure 18A:
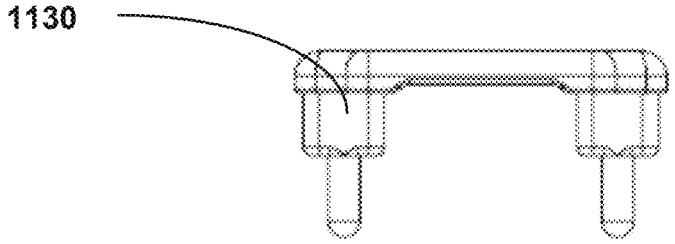
FIGS. 18A to 21B illustrate various examples of an accessory-receiving adaptor to be connected to an e-clip, in accordance with some embodiments.
Figure 18B:
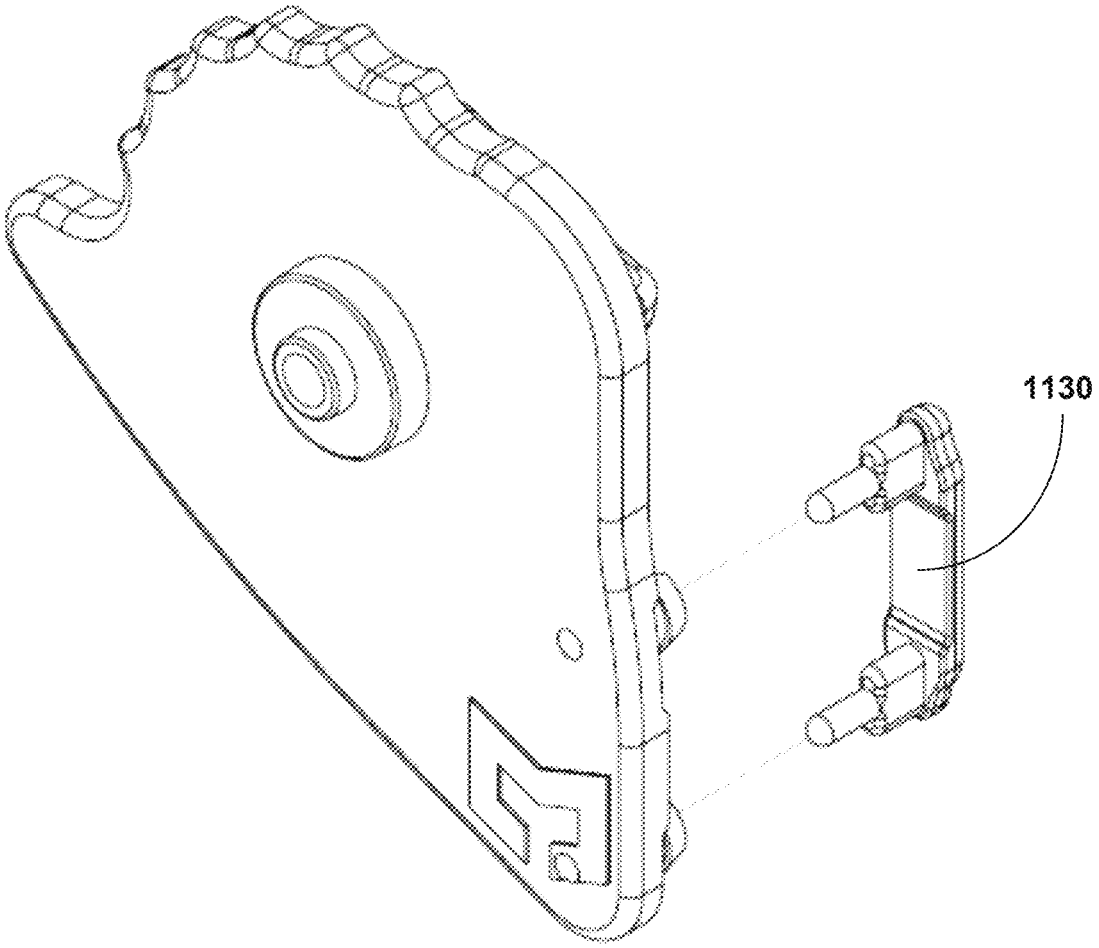

FIGS. 18A and 18B illustrate a U-bolt 1130 to be connected to an e-clip, in accordance with some embodiments. The u-clip (or U-bolt) is molded with pins going thru the e-clip but some "prongs" so that when snapped in place, the u-clip 1130 is secured. In this example, the e-clip has slots rather than holes to receive that u-clip design.

Figure 19A:
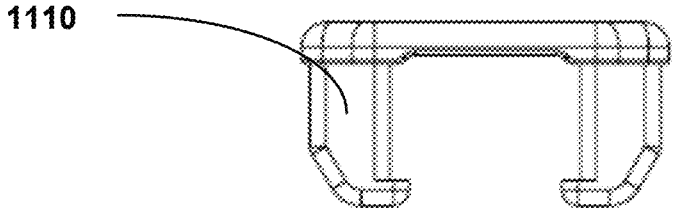
Figure 19B:
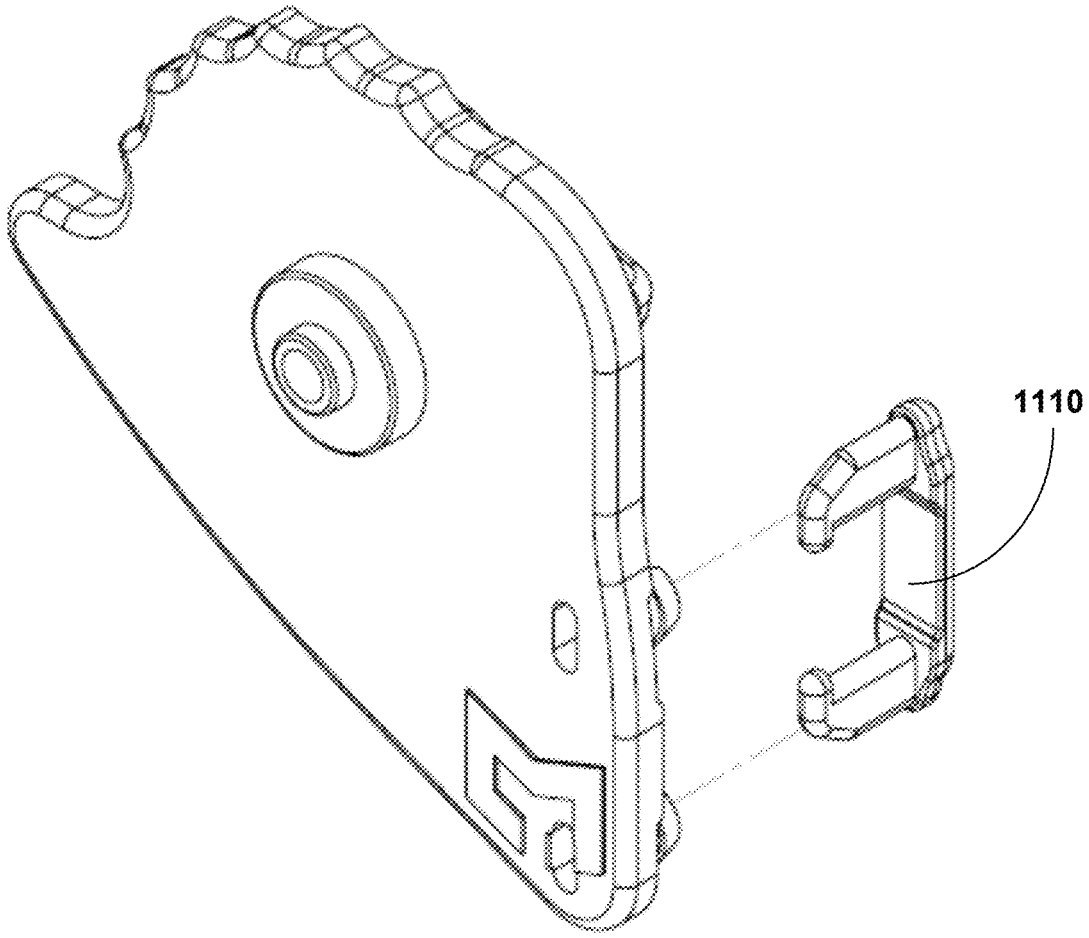

FIGS. 19A and 19B illustrate a U-bolt 1120 to be connected to an e-clip, in accordance with some embodiments.

Figure 20A:
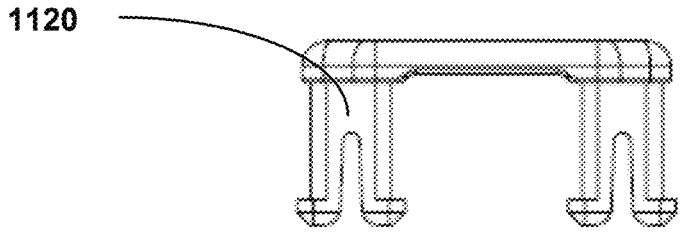
Figure 20B:
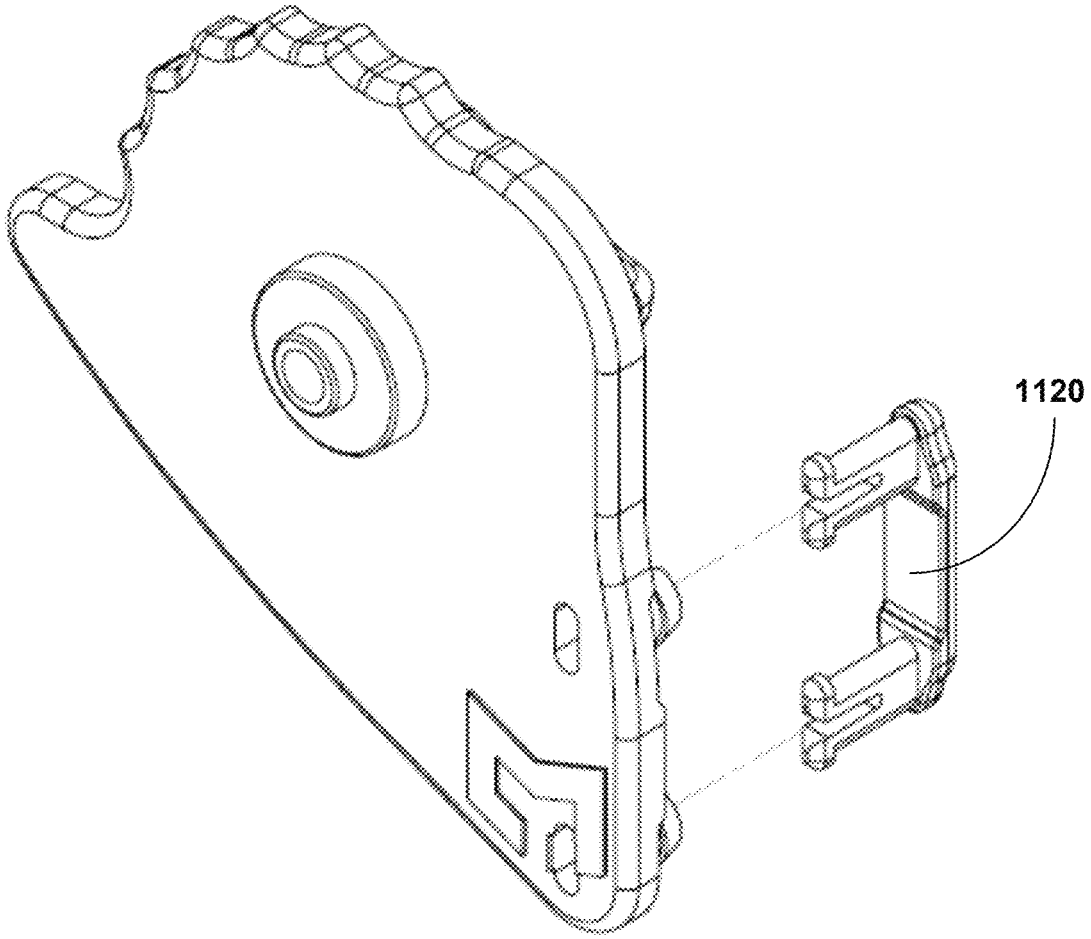

FIGS. 20A and 20B illustrate a U-bolt 1110 to be connected to an e-clip, in accordance with some embodiments.

Figure 21A:
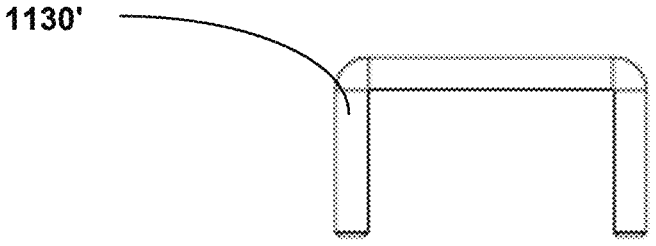
Figure 21B:
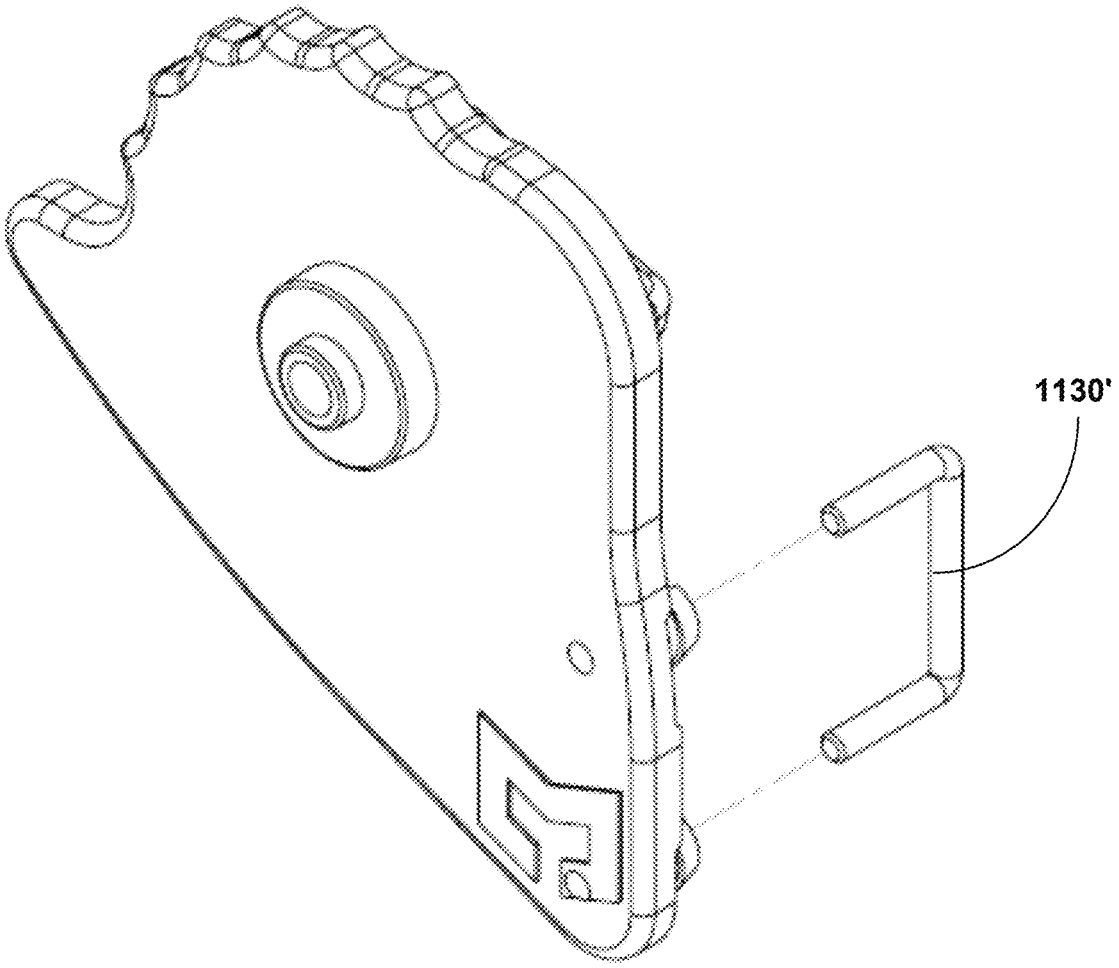

FIGS. 21A and 21B illustrate a variant of the U-bolt 1130' to be connected to the e- clip, in accordance with some embodiments. In some embodiments, two straight pins may be used in place of the single piece 1130'.

It should be understood that different combinations of the components described above may be implemented depending on the needs for the clip system. In some embodiments, the clip system 100, 200, 650, 700, 1200, 1400, 1600 or simply the adaptor 600, 605, 608, 730 may be added to a soft hat (e.g., baseball cap) where the soft hat would be placed between the clip system and a backing plate (e.g., plastic or aluminum plate) and held together using rivets, screws, darts, or other fastening means. U-bolts 1110, 1120, 1130, 1130' may be placed to secure ear muffs or other accessories to the cap.

Existing systems may be bulky, expensive to manufacture, have excessive number of parts, and other drawbacks. Some existing systems may be designed for heavy duty and rugged purposes necessitating expensive and complex designs and manufacturing. In some embodiments, the clip system 100, 200, 650, 700, 1200, 1400, 1600 is designed specifically for non-rugged use wherein low strength material and/or thin sheets of plastic and/or metal may be used in construction.

The discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification.

As can be understood, the examples described above and illustrated are intended to be exemplary only.

What is claimed is:

1. A clip system for attaching accessories to headgears, the clip system comprising:

a clip assembly, including:

a first clip attachable to a first accessory;

a first clip-receiving adaptor attachable to a headgear, wherein the first clip-receiving adaptor receives and fastens the first clip; and an accessory adaptor attachable to the first clip-receiving adaptor, wherein the accessory adaptor receives and fastens an accessory to the first clip-receiving adaptor and wherein the accessory adaptor comprises two pins attachably connected to recesses in the first clip-receiving adaptor.

2. The clip system as claimed in claim 1, wherein the two pins are held in the recesses by at least one of:

frictional engagement; or pressure.

3. The clip system as claimed in claim 1, wherein the accessory adaptor comprises:

a first component placed between the first clip-receiving adaptor and the headgear; and a second component attachably connected to the first component to hold the accessory to the first clip-receiving adaptor.

4. The clip system as claimed in claim 1, wherein at least one of:

the first clip-receiving adaptor is fastened to the headgear; and the first clip-receiving adaptor is sized to receive the first clip.

5. The clip system as claimed in claim 1, wherein the first clip includes:

a body;

an accessory-receiving portion;

a spacer component; and two legs with a spacing in-between, wherein the two legs have a predetermined or limited amount of flexibility such that the two legs may be squeezed to reduce the spacing when inserted into the first clip-receiving adaptor.

6. The clip system as claimed in claim 3, wherein the spacer component is substantially orthogonal to the clip and is configured to rest against the headgear.

7. The clip system as claimed in claim 3, wherein the accessory-receiving portion comprises a rotatable fastening portion to rotatably fasten the first accessory to the first clip.

8. The clip system as claimed in claim 5, wherein at least one of:

the two legs are configured to fasten to the first clip-receiving adaptor via an interference fit;

the rotatable fastening portion is substantially flat;

the rotatable fastening portion includes a substantially flat portion, and a rotatable fastening device;

the rotatable fastening portion includes at least one of flat members configured to fit in the first accessory- receiving portion via a frictional fit, or fastening members passing through a hole in the rotatable fastening portion to fasten to a complementary slot feature on the headgear;

the first clip is substantially flat;

the first accessory is a face shield; or the first accessory is an earmuff.

9. The clip system as claimed in claim 1, wherein the first clip-receiving adaptor is sized to receive the first clip portion.

10. The clip system as claimed in claim 1, wherein a second clip-receiving adaptor is attachable to the first clip-receiving adaptor, and configured to receive and fasten a second clip attachable to a second accessory.

11. The clip system as claimed in claim 1, wherein the first clip-receiving adaptor is attachable to a clip-receiving component of the headgear.

12. The clip system as claimed in claim 1, wherein:

the first clip-receiving component is attachable to the headgear at a location relative to a first ear of a wearer of the headgear; and a second clip-receiving component is attachable to the headgear at a location relative to a second ear of the wearer of the headgear.

13. The clip system as claimed in claim 10, wherein the first and second clip-receiving adaptors receive respective first and second clips attachable to a same accessory.

14. The clip system as claimed in claim 10, wherein the first and second clip-receiving adaptors receive respective first and second clips attachable to separate accessories.

15. The clip system as claimed in claim 1, wherein the headgear is one of a brim hat or a bump cap.

16. The clip system as claimed in claim 1, wherein the headgear is made of soft material and a reinforcing portion is added to attach the clip-receiving portion to the headgear.

17. The clip system as claimed in claim 1, wherein the rotatable fastening portion comprises a plurality of edges such that the respective accessory attached to the rotatable fastening portion is configured for a plurality of angular positions.

18. The clip system as claimed in claim 16, wherein the rotatable fastening portion is configured to allow a face shield to be rotated and locked into the plurality of angular positions.

19. The clip system as claimed in claim 18, wherein the plurality of angular positions vary at approximately 15 degree intervals.

20. A clip system for attaching accessories to headgears, the clip system comprising:

a clip assembly, including:

a first clip attachable to a first accessory;

a first clip-receiving adaptor attachable to a headgear, wherein the first clip-receiving adaptor receives and fastens the first clip; and an accessory adaptor attachable to the first clip-receiving adaptor, wherein the accessory adaptor receives and fastens an accessory to the first clip-receiving adaptor, wherein the accessory adaptor comprises:

a first component placed between the first clip-receiving adaptor and the headgear; and a second component attachably connected to the first component to hold the accessory to the first clip-receiving adaptor.

* * * * *